US011763725B2

(12) United States Patent
Lim et al.

(10) Patent No.: US 11,763,725 B2
(45) Date of Patent: Sep. 19, 2023

(54) DISPLAY DEVICE INCLUDING FIRST STAGES CONNECTED TO FIRST SCAN LINES AND SECOND STAGES CONNECTED TO SECOND SCAN LINES

(71) Applicant: SAMSUNG DISPLAY CO., LTD., Yongin-si (KR)

(72) Inventors: Jae Keun Lim, Yongin-si (KR); Han Bit Kim, Yongin-si (KR); Hong Soo Kim, Yongin-si (KR); Jin Young Roh, Yongin-si (KR); Se Hyuk Park, Yongin-si (KR); Hyo Jin Lee, Yongin-si (KR)

(73) Assignee: SAMSUNG DISPLAY CO., LTD., Gyeonggi-do (KR)

( * ) Notice: Subject to any disclaimer, the term of this patent is extended or adjusted under 35 U.S.C. 154(b) by 0 days.

(21) Appl. No.: 17/220,190

(22) Filed: Apr. 1, 2021

(65) Prior Publication Data

US 2022/0020311 A1 Jan. 20, 2022

(30) Foreign Application Priority Data

Jul. 20, 2020 (KR) ..... 10-2020-0089884

(51) Int. Cl.
*G09G 3/20* (2006.01)

(52) U.S. Cl.
CPC ..... *G09G 3/2092* (2013.01); *G09G 2310/027* (2013.01); *G09G 2310/0267* (2013.01); *G09G 2310/0278* (2013.01); *G09G 2310/08* (2013.01)

(58) Field of Classification Search
CPC ..... G09G 3/2092; G09G 2310/0267; G09G 2310/027; G09G 2310/0278; G09G 2310/08
See application file for complete search history.

(56) References Cited

U.S. PATENT DOCUMENTS

2006/0114219 A1* 6/2006 Park ..... G09G 3/3413 345/102
2008/0150859 A1* 6/2008 Song ..... G09G 3/3648 345/87
2008/0284704 A1* 11/2008 Song ..... G09G 3/3614 345/94

(Continued)

FOREIGN PATENT DOCUMENTS

KR 1020160064839 A 6/2016

*Primary Examiner* — Michael Pervan
(74) *Attorney, Agent, or Firm* — CANTOR COLBURN LLP

(57) ABSTRACT

A display device of the invention includes: a pixel portion including first pixel rows connected to first scan lines and second pixel rows connected to second scan lines; a scan driver including first and second stages connected to the first scan lines and the second scan lines; and a data driver connected to the first and second pixel rows through same data lines. The first stages are connected to first clock lines, the second stages are connected to second clock lines, a first start stage of the first stages and a second start stage of the second stages are connected to a same scan start line, each first stage excluding the first start stage is connected to a first scan line of a previous first stage, and each second stage excluding the second start stage is connected to a second scan line of a previous second stage.

12 Claims, 19 Drawing Sheets

(56) References Cited

U.S. PATENT DOCUMENTS

| | | | | |
|---|---|---|---|---|
| 2009/0153441 | A1* | 6/2009 | Takeuchi | G09G 3/293 345/60 |
| 2011/0043546 | A1* | 2/2011 | Matsumoto | G09G 3/3611 345/690 |
| 2011/0090196 | A1* | 4/2011 | Li | G09G 3/3648 345/209 |
| 2011/0164076 | A1* | 7/2011 | Lee | G09G 3/3677 345/698 |
| 2014/0225877 | A1* | 8/2014 | Nakanishi | G09G 3/3677 345/204 |
| 2014/0292820 | A1* | 10/2014 | Park | G06T 11/001 345/690 |
| 2015/0194121 | A1* | 7/2015 | Lee | G09G 3/3677 345/212 |
| 2016/0063962 | A1* | 3/2016 | Park | G09G 3/3611 345/211 |
| 2016/0155423 | A1 | 6/2016 | Shin | |

* cited by examiner

DISPLAY DEVICE INCLUDING FIRST STAGES CONNECTED TO FIRST SCAN LINES AND SECOND STAGES CONNECTED TO SECOND SCAN LINES

This application claims priority to Korean Patent Application No. 10-2020-0089884, filed on Jul. 20, 2020, and all the benefits accruing therefrom under 35 U.S.C. § 119, the content of which in its entirety is herein incorporated herein by reference.

BACKGROUND

(a) Field

Embodiments of the invention relate to a display device.

(b) Description of the Related Art

As information technology has developed, the importance of a display device, which is a connection medium between a user and information, has been highlighted. Accordingly, display devices, such as a liquid crystal display device, an organic light emitting display device, and a plasma display device, has been more widely used.

When a display device displays a moving image, it is desired to display the moving picture at a high frequency to smoothly display the motion thereof. However, when the display device displays a still image, the still image may be displayed at a low frequency since there is no motion. In addition, when the still image is displayed at a low frequency, power consumption may be decreased.

SUMMARY

In a display device where a moving image is displayed at a high frequency and a still image is displayed at a low frequency, a flicker may be viewed as a luminance reduction period is changed when a display frequency of the display device is switched from the high frequency to the low frequency.

Embodiments of the invention relate to a display device in which a flicker is effectively prevented from being viewed when a display frequency is switched from a high frequency to a low frequency.

An embodiment of the invention provides a display device including: a pixel portion including first pixel rows connected to first scan lines and second pixel rows alternating with the first pixel rows and connected to second scan lines; a scan driver including first stages connected to the first scan lines and second stages connected to the second scan lines; and a data driver connected to the first pixel rows and the second pixel rows through same data lines, where the first stages are connected to first clock lines, the second stages are connected to second clock lines different from the first clock lines, a first start stage of the first stages and a second start stage of the second stages are connected to a same scan start line, each of the first stages excluding the first start stage is connected to a first scan line of a previous first stage, and each of the second stages excluding the second start stage is connected to a second scan line of a previous second stage.

In an embodiment, the scan driver may apply scan signals of a turn-on level alternately to the first scan lines and the second scan lines during each first frame period.

In an embodiment, the scan driver may apply the scan signals of the turn-on level to the first scan lines, and maintain scan signals of a turn-off level at the second scan lines, during a first sub-frame period of each second frame period; and the scan driver may apply the scan signals of the turn-on level to the second scan lines, and maintain the scan signals of the turn-off level at the first scan lines, during a second sub-frame period of each second frame period.

In an embodiment, the second frame period may be longer than the first frame period.

In an embodiment, the second frame period may be an integer multiple of the first frame period.

In an embodiment, first clock signals of a turn-on level may be applied to the first clock lines, and second clock signals of a turn-on level may be applied to the second clock lines, during the first frame period; and the first clock signals and the second clock signals may have different phases from each other.

In an embodiment, the first clock signals of the turn-on level may be applied to the first clock lines, and the second clock signals of the turn-off level may be maintained at the second clock lines, during the first sub-frame period; and the second clock signals of the turn-on level may be applied to the second clock lines, and the first clock signals of the turn-off level may be maintained at the first clock lines, during the second sub-frame period.

In an embodiment, a cycle of applying the first clock signals of the turn-on level to the first clock lines in the first frame period may be the same as a cycle of applying the first clock signals of the turn-on level to the first clock lines in the first sub-frame period.

In an embodiment, a cycle of applying the second clock signals of the turn-on level to the second clock lines in the first frame period may be the same as a cycle of applying the second clock signals of the turn-on level to the second clock lines in the second sub-frame period.

In an embodiment, a cycle of applying the scan signals of the turn-on level to the first scan lines in the first frame period may be the same as a cycle of applying the scan signals of the turn-on level to the first scan lines in the first sub-frame period.

In an embodiment, a cycle of applying the scan signals of the turn-on level to the second scan lines in the first frame period may be the same as a cycle of applying the scan signals of the turn-on level to the second scan lines in the second sub-frame period.

In an embodiment, a cycle of applying the first clock signals of the turn-on level to the first clock lines in the first sub-frame period may be shorter than a cycle of applying the first clock signals of the turn-on level in the first frame period.

In an embodiment, a cycle of applying the second clock signals of the turn-on level to the second clock lines in the second sub-frame period may be shorter than a cycle of applying the second clock signals of the turn-on level in the first frame period.

In an embodiment, a cycle of applying the scan signals of the turn-on level to the first scan lines in the first sub-frame period may be shorter than a cycle of applying the scan signals of the turn-on level to the first scan lines in the first frame period.

In an embodiment, a cycle of applying the scan signals of the turn-on level to the second scan lines in the second sub-frame period may be shorter than a cycle of applying the scan signals of the turn-on level to the second scan lines in the first frame period.

In an embodiment, the data driver may be powered off during at least a portion of the first sub-frame period and the second sub-frame period.

In an embodiment, First data voltages supplied by the data driver to first dots of a first pixel row during the first sub-frame period and second data voltages supplied by the data driver to second dots of a second pixel row adjacent to the first dots during the second sub-frame period may be the same as each other for a same color, and each of the first and second dots may include pixels of at least two different colors.

In an embodiment, When a first pixel row and an adjacent second pixel row do not display an edge, first data voltages supplied by the data driver to first dots of the first pixel row during the first sub-frame period and second data voltages supplied by the data driver to second dots of the second pixel row adjacent to the first dots during the second sub-frame period may be the same as each other for a same color; when the first pixel row and the adjacent second pixel row display an edge, the first data voltages and the second data voltages may be different from each other for the same color; and each of the first dots and of the second dots may include pixels of at least two different colors.

In an embodiment, the display device may further include a timing controller which supplies a control signal to the scan driver and the data driver, wherein the timing controller may include a frame memory which stores an input image; an edge reinforcer which converts the input image in a way such that an edge of the input image is emphasized; an edge detector which detects an edge of a converted input image; and a common data generator which provides same grayscale levels to the first dots and the second dots when the first pixel row and the adjacent second pixel row do not correspond to the detected edge, and provides grayscale levels of the converted input image to the first dots and the second dots when the first pixel row and the adjacent second pixel row correspond to the detected edge.

In an embodiment, the timing controller may further include a pattern detector which generates pattern information on whether the converted input image corresponds to a previously stored pattern; when the input image corresponds to the pattern, the display device may operate in a first display mode including the first frame period; and when the input image does not correspond to the pattern, the display device may operate in a second display mode including the second frame period.

In such embodiments, the display device may prevent a flicker from being viewed when a display frequency is switched from a high frequency to a low frequency.

DETAILED DESCRIPTION

Figure 1:
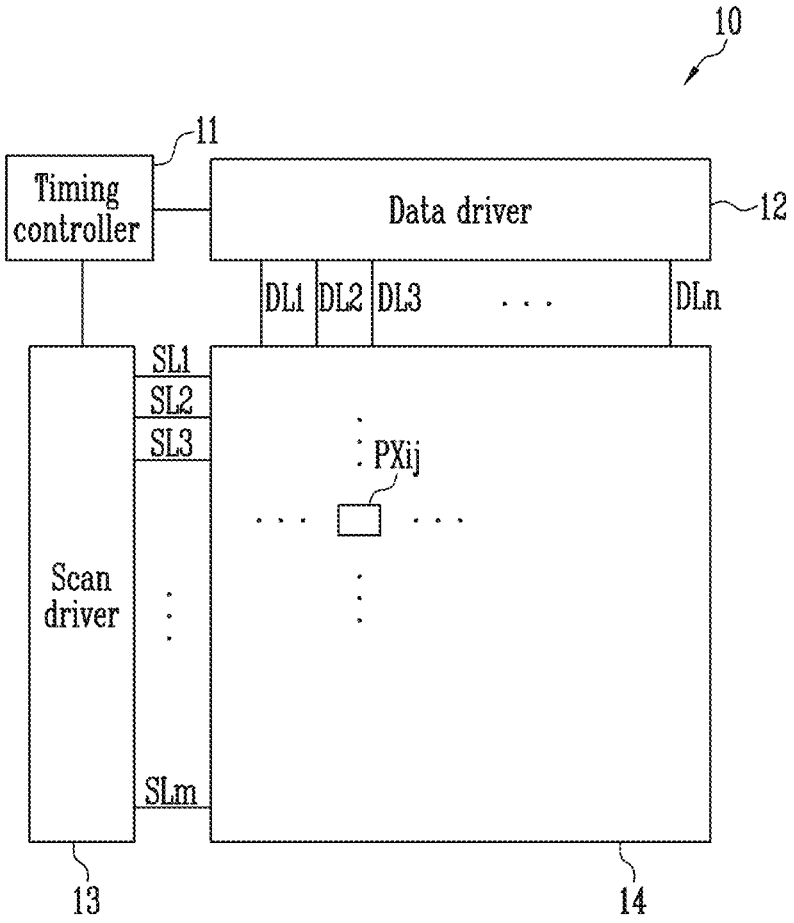
FIG. 1 illustrates a schematic view showing a display device according to an embodiment of the invention.

The invention will be described more fully hereinafter with reference to the accompanying drawings, in which various embodiments of the invention are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art.

Parts that are irrelevant to the description will be omitted to clearly describe the disclosure, and like reference numerals designate like elements throughout the specification.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, "a", "an," "the," and "at least one" do not denote a limitation of quantity, and are intended to include both the singular and plural, unless the context clearly indicates otherwise. For example, "an element" has the same meaning as "at least one element," unless the context clearly indicates otherwise. "At least one" is not to be construed as limiting "a" or "an." "or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Further, in the drawings, the size and thickness of each element are arbitrarily illustrated for ease of description, and the disclosure is not limited to those illustrated in the drawings. In the drawings, the thicknesses of layers, films, panels, regions, etc. may be exaggerated for clarity.

Hereinafter, embodiments of the invention will be described in detail with reference to the accompanying drawings.

FIG. 1 illustrates a schematic view showing a display device according to an embodiment of the invention.

Referring to FIG. 1, an embodiment of a display device 10 according to the invention may include a timing controller 11, a data driver 12, a scan driver 13, and a pixel portion 14.

The timing controller 11 may receive an external input signal from an external processor. The external input signal may include a vertical synchronization signal, a horizontal synchronization signal, a data enable signal, RGB data, or the like. The vertical synchronization signal may include a plurality of pulses, and may indicate that a previous frame period ends and a current frame period begins based on a time point at which each pulse is generated. An interval between adjacent pulses of the vertical synchronization signal may correspond to one frame period. The horizontal synchronization signal may include a plurality of pulses, and may indicate that a previous horizontal period ends and a new horizontal period begins based on a time point at which each pulse is generated. An interval between adjacent pulses of the horizontal synchronization signal may correspond to one horizontal period. The data enable signal may indicate that the RGB data is supplied in the horizontal period. The RGB data may be supplied in units of pixel rows in the horizontal periods in response to the data enable signal. The RGB data corresponding to one frame may be referred to as one input image. The timing controller 11 may determine consecutive input images as still images when grayscale levels of the consecutive input images are substantially the same as each other. The timing controller 11 may determine the continuous input images as moving pictures when the grayscale levels of the consecutive input images are substantially different from each other.

The data driver 12 may provide data voltages corresponding to grayscale levels of the input images to the pixels. In one embodiment, for example, the data driver 12 may sample grayscale levels by using a clock signal and apply data voltages corresponding to the grayscale levels to the data lines DL1 to DLn in units of pixel rows. The pixel row may mean pixels connected to the same scan line. Here, n may be an integer greater than zero.

The scan driver 13 may receive a clock signal, a scan start signal, and the like from the timing controller 11 to generate scan signals to be provided to scan lines (SL1, SL2, SL3, . . . , SLm). Here, m may be an integer greater than zero.

The pixel portion 14 includes pixels. Each pixel PXij may be connected to a corresponding data line of the data lines DL1 to DLn and a corresponding scan line of the scan lines SL1 to SLm. Here, i and j may be integers greater than zero. A pixel PXij may mean a pixel in which a scan transistor is connected to an i-th scan line SLi and a j-th data line DLj.

Figure 2:
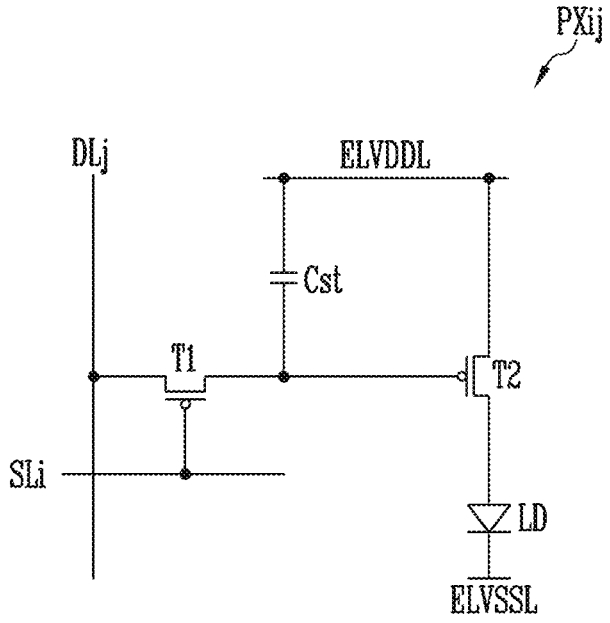
FIG. 2 illustrates a schematic view showing a pixel according to an embodiment of the invention.

FIG. 2 illustrates a schematic view showing a pixel according to an embodiment of the invention.

In an embodiment of the pixel PXij connected to the i-th scan line SLi and the j-th data line DLj, a gate electrode of a first transistor T1 may be connected to an i-th scan line SLi, a first electrode of the first transistor T1 may be connected to a j-th data line DLj, and a second electrode of the first transistor T1 may be connected to a second electrode of a storage capacitor Cst. The first transistor T1 may be referred to as a scan transistor.

A gate electrode of a second transistor T2 may be connected to the second electrode of the first transistor T1, a first electrode of the second transistor T2 may be connected to a first power line ELVDDL, and a second electrode of the second transistor T2 may be connected to the anode of a light emitting diode LD. The second transistor T2 may be referred to as a driving transistor.

A first electrode of the storage capacitor Cst may be connected to the first power line ELVDDL, and the second electrode of the storage capacitor Cst may be connected to the gate electrode of the second transistor T2.

The anode of the light emitting diode LD may be connected to the second electrode of the second transistor T2, and a cathode of the light emitting diode LD may be connected to a second power line ELVSSL. During a light emission period of the light emitting diode LD, a first power voltage applied to the first power line ELVDDL may be greater than a second power voltage applied to the second power line ELVSSL.

In an embodiment, as shown in FIG. 2, the first and second transistors T1 and T2 may be P-type transistors, but not being limited thereto. Alternatively, at least one of the transistors may be a N-type transistor with a signal having an inverted phase.

When a scan signal of a turn-on level (here, a logic low level) is applied through the scan line SLi, the first transistor T1 is turned on. When the first transistor T1 is turned on, a data voltage applied to the data line DLj is stored in the storage capacitor Cst.

A driving current, which corresponds to a voltage difference between the first electrode and the second electrode of the storage capacitor Cst, flows between the first electrode and the second electrode of the second transistor T2. Thus, the light emitting diode LD emits light with luminance corresponding to the data voltage.

Next, when a scan signal of a turn-off level (here, a logic high level) is applied through the scan line SLi, the first transistor T1 is turned off, and the data line DLj and the second electrode of the storage capacitor Cst are electrically separated. Therefore, even if the data voltage of the data line DLj is changed, the voltage stored in the second electrode of the storage capacitor Cst is not changed.

In such an embodiment, other pixels may have a same structure as that of the pixel PXij shown in FIG. 2, and any repetitive detailed description of the other pixels will be omitted.

Figure 3:
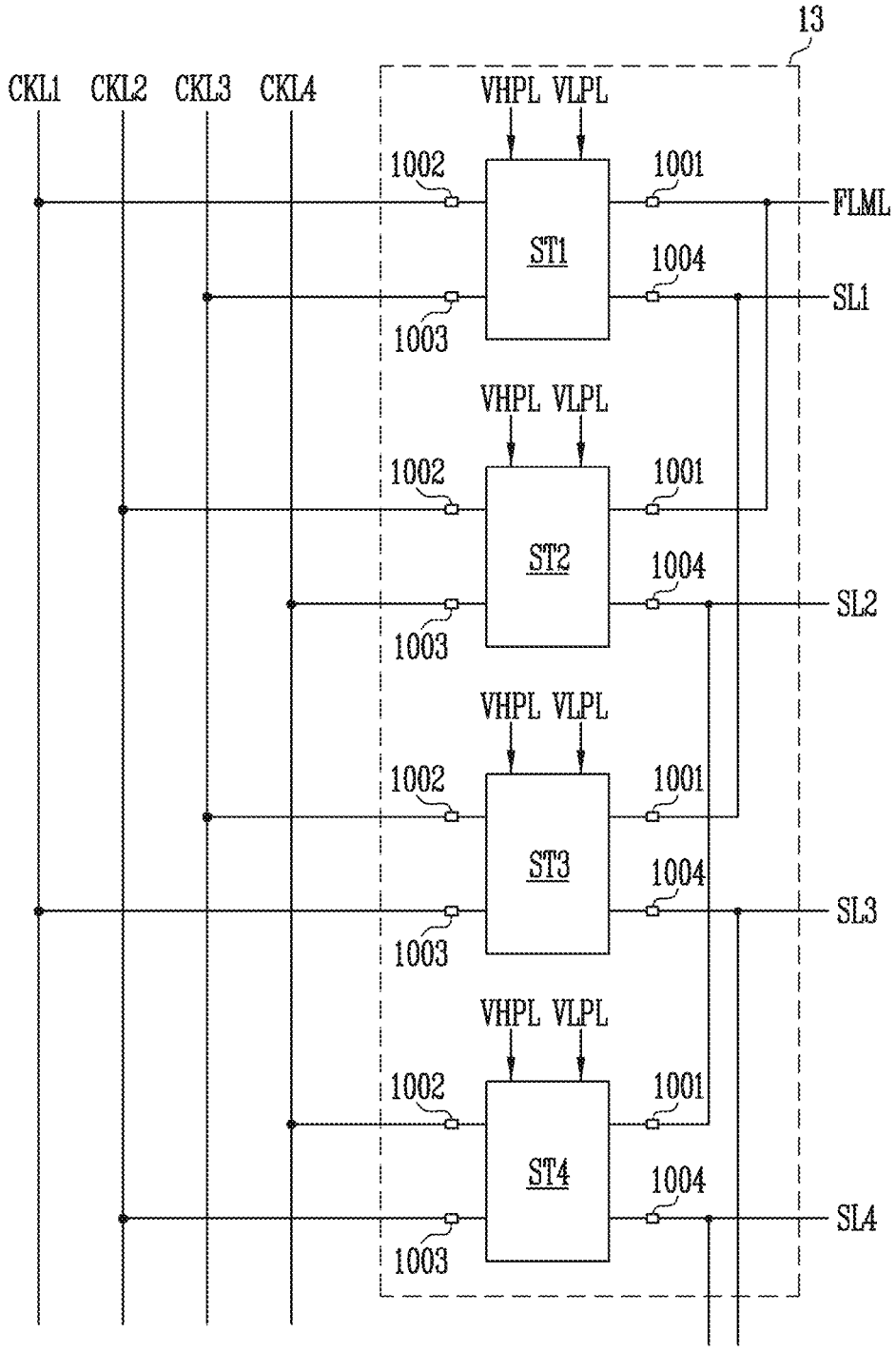
FIG. 3 illustrates a schematic view showing a scan driver according to an embodiment of the invention.

FIG. 3 illustrates a schematic view showing a scan driver according to an embodiment of the invention.

An embodiment of the scan driver 13 may include first stages (ST1, ST3, . . . ) connected to the first scan lines (SL1, SL3, . . . ) and second stages (ST2, ST4, . . . ) connected to the second scan lines (SL2, SL4, . . . ).

The first scan lines (SL1, SL3, . . . ) may be connected to the first pixel rows. In one embodiment, for example, the first pixel rows may be odd-numbered pixel rows. In such an embodiment, the first scan lines (SL1, SL3, . . . ) may be odd-numbered scan lines, and the first stages (ST1, ST3, . . . ) may be odd-numbered stages.

The second scan lines (SL2, SL4, . . . ) may be connected to the second pixel rows. In one embodiment, for example, the second pixel rows may be even-numbered pixel rows. In such an embodiment, the second scan lines (SL2, SL4, . . .

) may be even-numbered scan lines, and the second stages (ST2, ST4, . . . ) may be even-numbered stages.

Each of the stages ST1 to ST4 may be include a first input terminal 1001, a second input terminal 1002, a third input terminal 1003, and an output terminal 1004. The first start stage ST1 of the first stages (ST1, ST3, . . . ) and the second start stage ST2 of the second stages (ST2, ST4, . . . ) may be connected to a same scan start line FLML. In one embodiment, for example, the first input terminal 1001 of the first start stage ST1 and the first input terminal 1001 of the second start stage ST2 may be connected to the same scan start line FLML. In such an embodiment, the output terminal 1004 of the first start stage ST1 may be connected to the first scan line SL1, and the output terminal 1004 of the second start stage ST2 may be connected to the second scan line SL2.

Each of the first stages (ST3, . . . ) excluding the first start stage ST1 may be connected to the first scan line of the previous first stage. Each of the second stages (ST4, . . . ) excluding the second start stage ST2 may be connected to the second scan line of the previous second stage. In one embodiment, for example, the first input terminal 1001 of the first stage ST3 may be connected to the first scan line SL1 of the first start stage ST1. In such an embodiment, the first input terminal 1001 of the second stage ST4 may be connected to the second scan line SL2 of the second start stage ST2.

The first stages (ST1, ST3, . . . ) may be connected to first clock lines CKL1 and CKL3. The first clock lines CKL1 and CKL3 may be alternately connected to the second input terminal 1002 and the third input terminal 1003 of the first stages (ST1, ST3, . . . ). The second stages (ST2, ST4, . . . ) may be connected to second clock lines CKL2 and CKL4 different from the first clock lines CKL1 and CKL3. The second clock lines CKL2 and CKL4 may be alternately connected to the second input terminal 1002 and the third input terminal 1003 of the second stages (ST2, ST4, . . . ).

Each of the stages ST1 to ST4 may be connected to a power line VHPL and a power line VLPL. In such an embodiment, a voltage of the power line VHPL may be set to a turn-off level (gate-off voltage, logic high level), and a voltage of the power line VLPL may be set to a turn-on level (gate-on voltage, logic low level).

In an embodiment, as shown in FIG. 3, the first start stage ST1 and the second start stage ST2 are connected to the same scan start line FLML, but not being limited thereto. In an alternative embodiment, the first start stage ST1 and the second start stage ST2 may be connected to different scan start lines from each other.

Figure 4:
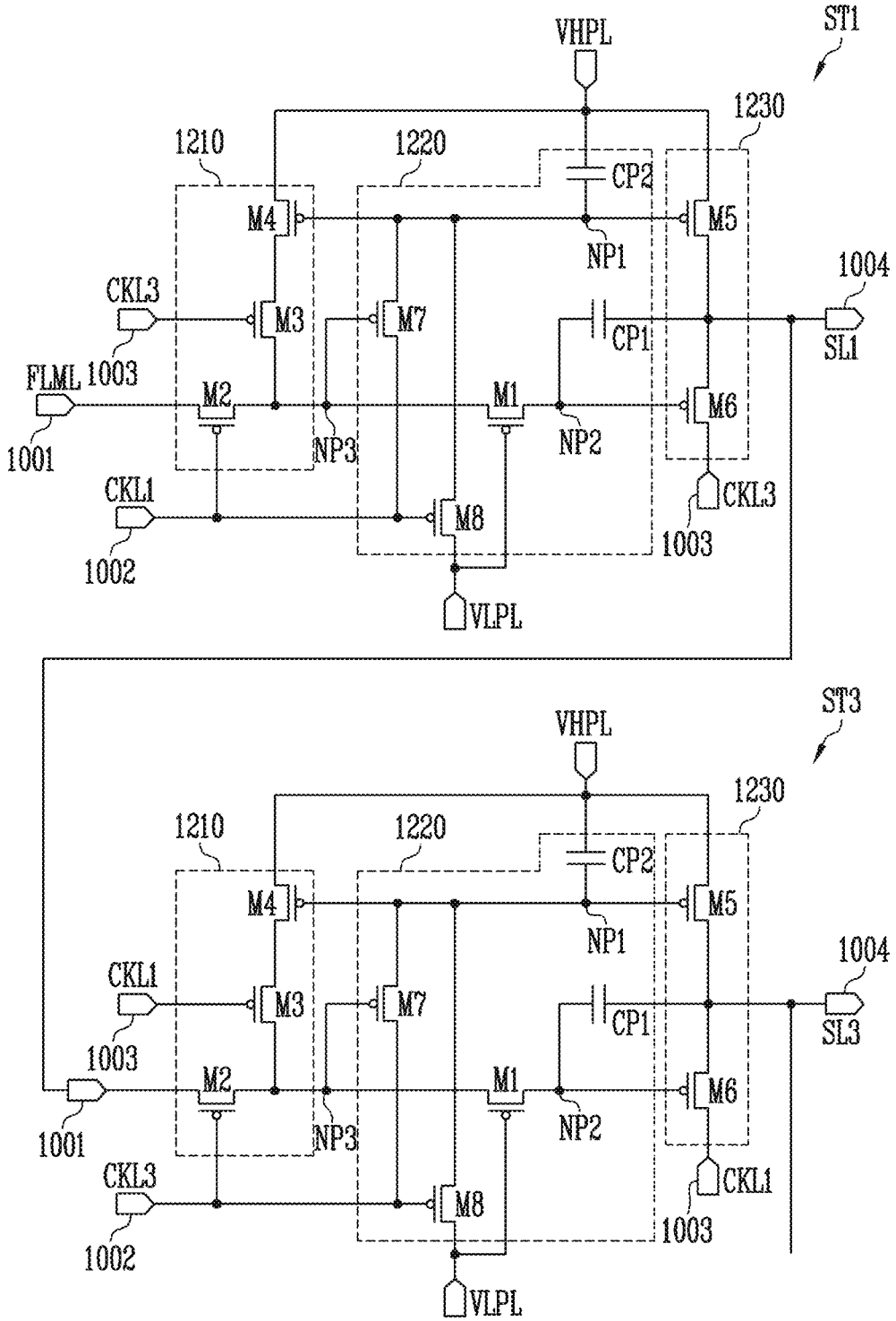
FIG. 4 illustrates a schematic view showing a stage according to an embodiment of the invention.

FIG. 4 illustrates a schematic view showing a stage according to an embodiment of the invention.

In FIG. 4, for convenience of illustration and description, the first start stage ST1 and the first stage ST3 are shown. Referring to FIG. 4, the first start stage ST1 may include a first driver 1210, a second driver 1220, and an output portion (buffer) 1230.

The output portion 1230 controls a voltage supplied to the output terminal 1004 in response to voltages of a first node NP1 and a second node NP2. In an embodiment, the output portion 1230 includes a fifth transistor M5 and a sixth transistor M6.

The fifth transistor M5 is disposed between the power line VHPL and the output terminal 1004, and a gate electrode of the fifth transistor M5 is connected to the first node NP1. The fifth transistor M5 controls connection between the power line VHPL and the output terminal 1004 in response to a voltage applied to the first node NP1.

The sixth transistor M6 is disposed between the output terminal 1004 and the third input terminal 1003, and a gate electrode of the sixth transistor M6 is connected to the second node NP2. The sixth transistor M6 controls a connection between the output terminal 1004 and the third input terminal 1003 in response to a voltage applied to the second node NP2. The output portion 1230 is driven as a buffer. In such an embodiment, the fifth and sixth transistors M5 and M6 may be configured by connecting a plurality of transistors in parallel.

The first driver 1210 controls a voltage of a third node NP3 in response to signals supplied to the first input terminal 1001 to the third input terminal 1003. In an embodiment, the first driver 1210 includes second to fourth transistors M2 to M4.

The second transistor M2 is disposed between the first input terminal 1001 and the third node NP3, and a gate electrode of the second transistor M2 is connected to the second input terminal 1002. The second transistor M2 controls connection between the first input terminal 1001 and the third node NP3 in response to a signal supplied to the second input terminal 1002.

The third transistor M3 and the fourth transistor M4 are connected in series between the third node NP3 and the power line VHPL. The third transistor M3 is disposed between the fourth transistor M4 and the third node NP3, and a gate electrode of the third transistor M3 is connected to the third input terminal 1003. The third transistor M3 controls a connection between the fourth transistor M4 and the third node NP3 in response to a signal supplied to the third input terminal 1003.

The fourth transistor M4 is disposed between the third transistor M3 and the power line VHPL, and a gate electrode of the fourth transistor M4 is connected to the first node NP1. The fourth transistor M4 controls a connection between the third transistor M3 and the power line VHPL in response to a voltage of the first node NP1.

The second driver 1220 controls a voltage of the first node NP1 in response to voltages of the second input terminal 1002 and the third node NP3. In an embodiment, the second driver 1220 includes a first transistor M1, a seventh transistor M7, an eighth transistor M8, a first capacitor CP1, and a second capacitor CP2.

The first capacitor CP1 is connected between the second node NP2 and the output terminal 1004. The first capacitor CP1 is charged with a voltage based on turn-on and turn-off operation of the sixth transistor M6.

The second capacitor CP2 is connected between the first node NP1 and the power line VHPL. The second capacitor CP2 is charged with a voltage applied to the first node NP1.

The seventh transistor M7 is disposed between the first node NP1 and the second input terminal 1002, and a gate electrode of the seventh transistor M7 is connected to the third node NP3. The seventh transistor M7 controls a connection between the first node NP1 and the second input terminal 1002 in response to a voltage of the third node NP3.

The eighth transistor M8 is disposed between the first node NP1 and the power line VLPL, and a gate electrode of the eighth transistor M8 is connected to the second input terminal 1002. The eighth transistor M8 controls a connection between the first node NP1 and the power line VLPL in response to a signal of the second input terminal 1002.

The first transistor M1 is disposed between the third node NP3 and the second node NP2, and a gate electrode of the first transistor M1 is connected to the power line VLPL. The first transistor M1 maintains an electrical connection between the third node NP3 and the second node NP2 while maintaining a turn-on state. In an embodiment, the first transistor M1 limits a voltage drop width of the third node NP3 in response to a voltage of the second node NP2. In such an embodiment, even if a voltage of the second node NP2 drops to a voltage lower than that of the power line VLPL, a voltage of the third node NP3 is not lower than a voltage obtained by subtracting a threshold voltage of the first transistor M1 from the voltage the power line VLPL.

Figure 5:
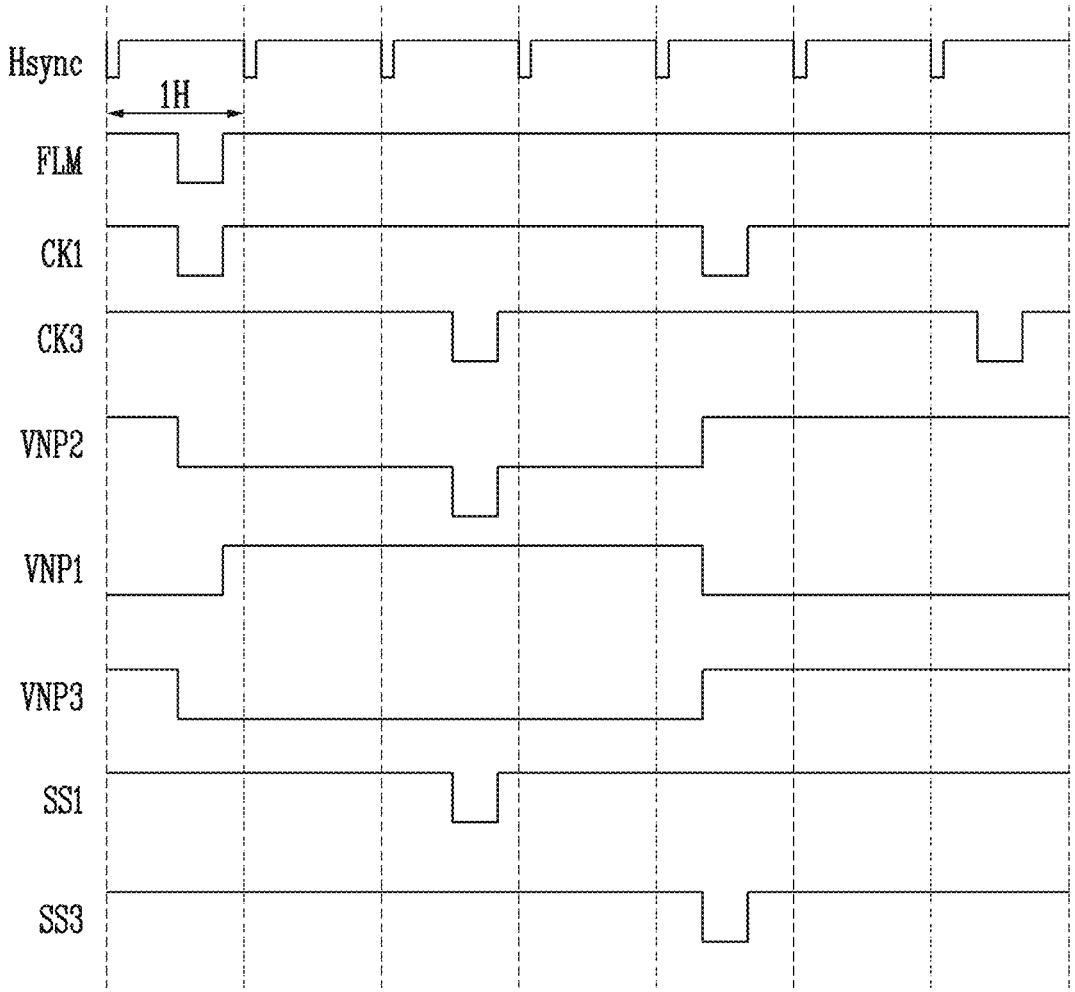
FIG. 5 illustrates a schematic view showing a driving method of a scan driver according to an embodiment of the invention.

FIG. 5 illustrates a schematic view showing a driving method of a scan driver according to an embodiment of the invention. In FIG. 5, for ease of description, an operation process will be described with reference to the first start stage ST1.

Referring to FIG. 5, in an embodiment, a first clock signal CK1 and a first clock signal CK3 have a cycle of 4 horizontal periods (4H), and are supplied in different horizontal periods from each other. In such an embodiment, the first clock signal CK3 is set as a signal shifted (or delayed) by a half cycle (that is, 2 horizontal periods) from the first clock signal CK1. In such an embodiment, the scan start signal FLM supplied to the first input terminal 1001 may be supplied in synchronization with the first clock signal CK1 supplied to the second input terminal 1002. One horizontal period (1H) may correspond to a cycle of pulses of a horizontal synchronization signal Hsync.

Supply of specific signals may mean that the specific signals have a turn-on level (here, a logic low level). Stopping the supply of specific signals may mean that the clock specific signals have a turn-off level (here, a logic high level).

In an embodiment, when the scan start signal FLM is supplied, the first input terminal 1001 may be set to a voltage of the logic low level, and when the scan start signal FLM is not supplied, the first input terminal 1001 may be set to a voltage of the logic high level. In such an embodiment, when a clock signal is supplied to the second input terminal 1002 and the third input terminal 1003, the second input terminal 1002 and the third input terminal 1003 may be set to a voltage of the logic low level, and when the clock signal is not supplied thereto, the second input terminal 1002 and the third input terminal 1003 may be set to a voltage of the logic high level, When the operation process of the scan driver starts, the scan start signal FLM is first supplied to be synchronized with the first clock signal CK1.

In an embodiment, as shown in FIGS. 4 and 5, when the first clock signal CK1 is supplied, the second an eighth transistors M2 and M8 are turned on. When the second transistor M2 is turned on, the first input terminal 1001 and the third node NP3 are electrically connected to each other. Here, since the first transistor M1 is turned on in most of the period, the second node NP2 maintains an electrical connection thereof with the third node NP3.

When the first input terminal 1001 and the third node NP3 are electrically connected to each other, voltages VNP2 and VNP3 of the second and third nodes NP2 and NP3 are set to the low levels by the scan start signal FLM supplied to the first input terminal 1001. When the voltages VNP2 and VNP3 of the second and third node NP2 and NP3 are set to the low level, the sixth transistor M6 and the seventh transistor M7 are turned on.

When the sixth transistor M6 is turned on, the third input terminal 1003 and the output terminal 1004 are electrically connected to each other. In such an embodiment, the third input terminal 1003 is set to the high level voltage (that is, the first clock signal CK3 is not supplied), and accordingly, the high level voltage is also outputted to the output terminal 1004. When the seventh transistor M7 is turned on, the second input terminal 1002 and the first node NP1 are electrically connected to each other. Accordingly, the voltage VNP1 of the first node NP1 is set to the low level based on the first clock signal CK1 supplied to the second input terminal 1002.

In such an embodiment, when the first clock signal CK1 is supplied, the eighth transistor M8 is turned on. When the eighth transistor M8 is turned on, the voltage of the power line VLPL is supplied to the first node NP1. Here, the voltage of the power line VLPL is set to the same (or similar) voltage as the low level of the first clock signal CK1, and accordingly, the first node NP1 stably maintains the low level voltage.

When the first node NP1 is set to the low level voltage, the fourth transistor M4 and the fifth transistor M5 are turned on. When the fourth transistor M4 is turned on, the power line VHPL and the third transistor M3 are electrically connected to each other. Here, since the third transistor M3 is set to the turn-off state, the third node NP3 stably maintains the low level voltage even when the fourth transistor M4 is turned on. When the fifth transistor M5 is turned on, the voltage of the power line VHPL is supplied to the output terminal 1004. Here, the voltage of the power line VHPL is set to the same (or similar) voltage as the high level voltage supplied to the third input terminal 1003, and accordingly, the output terminal 1004 stably maintains the high level voltage.

Thereafter, the supply of the scan start signal FLM and the first clock signal CK1 is stopped. When the supply of the first clock signal CK1 is stopped, the second and eighth transistors M2 and M8 are turned off. In this case, the sixth transistor M6 and the seventh transistor M7 maintain a turn-on state in response to a voltage stored in the first capacitor CP1. That is, the second node NP2 and the third node NP3 maintain the low level voltage by the voltage stored in the first capacitor CP1.

When the sixth transistor M6 maintains the turn-on state, the output terminal 1004 and the third input terminal 1003 maintain their electrical connection. When the seventh transistor M7 maintains the turn-on state, the first node NP1 maintains an electrical connection with the second input terminal 1002. Here, the voltage of the second input terminal 1002 is set to the high level voltage in response to stopping of the supply of the first clock signal CK1, and accordingly, the first node NP1 is also set to the high level voltage. When the high level voltage is supplied to the first node NP1, the fourth and fifth transistors M4 and M5 are turned off.

Thereafter, the first clock signal CK3 is supplied to the third input terminal 1003. In this case, since the sixth transistor M6 is set to the turn-on state, the first clock signal CK3 supplied to the third input terminal 1003 is supplied to the output terminal 1004. In this case, the output terminal 1004 outputs the first clock signal CK3 as a scan signal SS1 of a turn-on level to the first scan line SL1.

In such an embodiment, when the first clock signal CK3 is supplied to the output terminal 1004, the voltage of the second node NP2 is lowered to a voltage lower than that of the power line VLPL due to coupling of the first capacitor CP1, and accordingly, the sixth transistor M6 stably maintains the turn-on state.

In such an embodiment, even if the voltage of the second node NP2 is lowered, the third node NP3 may approximately maintain the voltage of the power line VLPL (for example, a voltage obtained by subtracting a threshold voltage of the first transistor M1 from the voltage of the power line VLPL) by the first transistor M1.

After the first scan signal SS1 of the turn-on level is outputted to the first scan line SL1, the supply of the first clock signal CK3 is stopped. When the supply of the first clock signal CK3 is stopped, the output terminal 1004 outputs the high level voltage. In addition, the voltage VNP2 of the second node NP2 increases to approximately the voltage of the power line VLPL in response to the high level voltage of the output terminal 1004.

Thereafter, the first clock signal CK1 is supplied. When the first clock signal CK1 is supplied, the second and eighth transistors M2 and M8 are turned on. When the second transistor M2 is turned on, the first input terminal 1001 and the third node NP3 are electrically connected. In this case, the scan start signal FLM is not supplied to the first input terminal 1001, and accordingly, the scan start signal FLM is set to the high level voltage. Accordingly, when the first transistor M1 is turned on, the high level voltage is supplied to the third node NP3 and the second node NP2, and accordingly, the sixth transistor M6 and the seventh transistor M7 are turned off.

When the eighth transistor M8 is turned on, the voltage of the power line VLPL is supplied to the first node NP1, and accordingly, the fourth and fifth transistors M4 and M5 are turned on. When the fifth transistor M5 is turned on, the voltage of the power line VHPL is supplied to the output terminal 1004. Thereafter, the fourth transistor M4 and the fifth transistor M5 maintain the turn-on state corresponding to the voltage charged in the second capacitor CP2, and accordingly, the output terminal 1004 stably receives the voltage of the power line VHPL.

Additionally, when the first clock signal CK3 is supplied, the third transistor M3 is turned on. At this time, since the fourth transistor M4 is set to the turn-on state, the voltage of the power line VHPL is supplied to the third node NP3 and the second node NP2. In this case, the sixth and seventh transistors M6 and M7 are stably maintained in the turn-off state.

The first stage ST3 receives the output signal (that is, a scanning signal) of the first stage ST1 in synchronization with the first clock signal CK3. In this case, the first stage ST3 outputs a first scan signal SS3 of the turn-on level to the first scan line SL3 in synchronization with the first clock signal CK1. The first stages (ST1, ST3, . . . ) sequentially output the turn-on level scan signal to the first scan lines (SL1, SL3, . . . ) while repeating the above-described process.

The description of the first stages (ST1, ST3, . . . ) in FIG. 4 and FIG. 5 may be substantially equally applied to the second stages (ST2, ST4, . . . ). The embodiments of the stage and the driving method thereof described above with reference to FIG. 4 and FIG. 5 are merely exemplary, and the stage and the driving method thereof may be variously modified.

FIG. 6 to FIG. 9 illustrate schematic views showing a first frame period and a second frame period according to an embodiment of the invention.

The display device 10 may operate in a first display mode including a plurality of first frame periods FP1 or a second display mode including a plurality of second frame periods FP2. The second frame period FP2 may be longer than the first frame period FP1. In one embodiment, for example, the second frame period FP2 may be an integer multiple of the first frame period FP1. In one embodiment, for example, the second frame period FP2 may be $2p$ times the first frame period FP1, and p may be an integer greater than 0. In an embodiment, as shown in FIG. 6, the second frame period FP2 is twice the first frame period FP1.

The first display mode is for displaying a moving picture by displaying input images (frames) at a high frequency, and the second display mode is for displaying a still image by displaying the input images at a low frequency. When a still image is detected while displaying a moving picture, the display device 10 may switch from the first display mode to the second display mode. In addition, when a moving picture is detected while displaying a still image, the display device 10 may switch from the second display mode to the first display mode.

Figure 6:
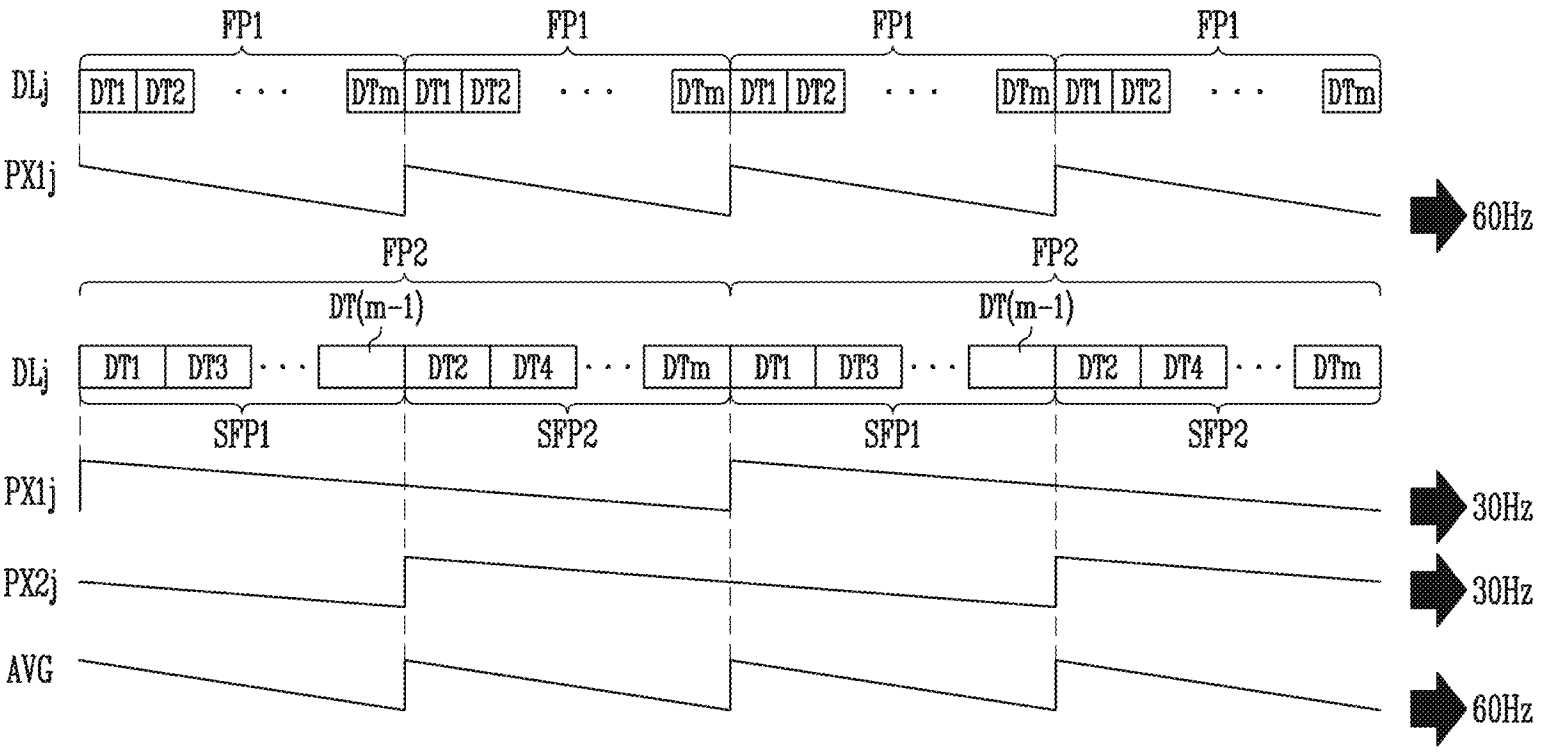
FIG. 6 to FIG. 9 illustrate schematic views showing a first frame period and a second frame period according to an embodiment of the invention.

Referring to FIG. 6, for convenience of description, the j-th data line DLj and the pixels PX1*j* and PX2*j* connected to the j-th data line DLj will be mainly described. The first pixel PX1*j* is connected to the j-th data line and the first scan line SL1. The first pixel PX1*j* is included in the first pixel row. The second pixel PX2*j* is connected to the j-th data line and the second scan line SL2. The second pixel PX2*j* is included in the second pixel row.

In each first frame period FP1, the data driver 12 may sequentially apply data voltages corresponding to the first pixel rows and the second pixel rows to the data lines. In one embodiment, for example, the data driver 12 may sequentially apply the data voltages (DT1, DT2, . . . , DT(m-1), DTm) to the j-th data line DLj. In an embodiment where the first frame period FP1 is 1/60 second, the first data voltage DT1 may be supplied to the first pixel PX1*j* at 60 hertz (Hz). The first pixel PX1*j* emits light with the luminance corresponding to the first data voltage DT1 when the first data voltage DT1 is applied thereto, and then the luminance thereof may gradually decreases due to a leakage current. Referring to FIG. 6, luminance waveforms of the first pixel PX1*j* corresponding to the plurality of first frame periods FP1 are exemplarily illustrated.

Each second frame period FP2 may include a first sub-frame period SFP1 and a second sub-frame period SFP2. Lengths of the first sub-frame period SFP1 and the second sub-frame period SFP2 may be the same as each other. In one embodiment, for example, the second frame period FP2 is 1/30 second, and each of the first sub-frame period SFP1 and the second sub-frame period SFP2 may be 1/60 second.

In each first sub-frame period SFP1, the data driver 12 may sequentially apply data voltages corresponding to the first pixel rows to the data lines. In one embodiment, for example, the data driver 12 may sequentially apply the data voltages (DT1, DT3, . . . , DT(m-1)) to the j-th data line DLj. In each second sub-frame period SFP2, the data driver 12 may sequentially apply data voltages corresponding to the second pixel rows to the data lines. In one embodiment, for example, the data driver 12 may sequentially apply the data voltages (DT2, DT4, . . . , DTm) to the j-th data line DLj.

Accordingly, the first data voltage DT1 may be supplied to the first pixel PX1*j* at 30 Hz. The first pixel PX1*j* emits light with the luminance corresponding to the first data voltage DT1 at a point of time at which the first data voltage DT1 is applied thereto, and then the luminance thereof may gradually decreases due to a leakage current. Referring to FIG. 6, luminance waveforms of the first pixel PX1*j* corresponding to the plurality of second frame periods FP2 are exemplarily illustrated. In addition, the second data voltage DT2 may be applied to the second pixel PX2*j* at 30 Hz. The second pixel PX2*j* emits light with the luminance corresponding to the second data voltage DT2 at a point of time at which the second data voltage DT2 is applied thereto, and then the luminance thereof may gradually decreases due to a leakage current. Referring to FIG. 6, luminance waveforms of the second pixel PX2*j* corresponding to the plurality of second frame periods FP2 are exemplarily illustrated.

In such an embodiment, unless an input image has a specific pattern such as a horizontal stripe image, since the first pixel PX1*j* and the second pixel PX2*j* are disposed adjacent to each other, the first data voltage DT1 and the second data voltage DT2 may be generally the same as or similar to each other.

Since a point of time at which the first pixel PX1*j* has the highest luminance and a point of time at which the second pixel PX2*j* has the highest luminance are alternately positioned, a user may recognize an average luminance waveform AVG of the first pixel PX1*j* and the second pixel PX2*j* as 60 Hz. Therefore, even when the first display mode and the second display mode are switched, a flicker due to a difference in the luminance waveform may be effectively prevented from being viewed.

Figure 7:
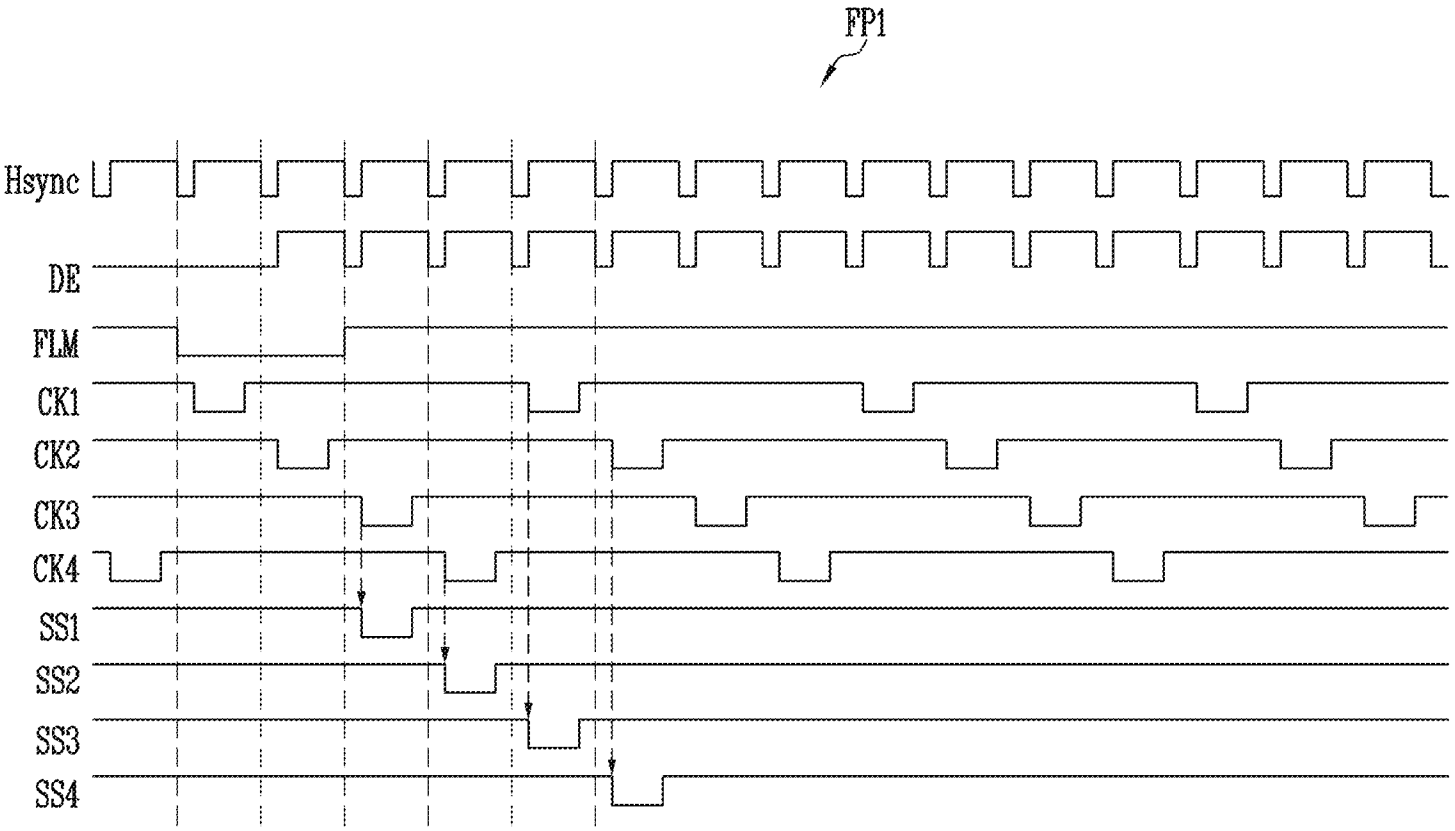

Referring to FIG. 7, control signals in the first frame period FP1 are exemplarily shown.

During the first frame period FP1, the timing controller 11 may apply the first clock signals CK1 and CK3 of the turn-on level to the first clock lines CKL1 and CKL3, and may apply the second clock signals CK2 and CK4 of the turn-on level to the second clock lines CKL2 and CKL4. The first clock signals CK1 and CK3 and the second clock signals CK2 and CK4 may have different phases. In one embodiment, for example, the clock signals CK1, CK2, CK3, and CK4 of the turn-on level may be sequentially supplied in the order of the first clock line CKL1, the second clock line CKL2, the first clock line CKL3, and the second clock line CKL4. In one embodiment, for example, each cycle of the clock signals CK1, CK2, CK3, and CK4 of the turn-on level may be 4 horizontal periods.

In addition, the timing controller 11 may apply the scan start signal FLM of the turn-on level to the scan start line FLML. In this case, a length of the scan start signal FLM of the turn-on level may be set to overlap the first clock signal CK1 of the turn-on level and the second clock signal CK2 of the turn-on level. In one embodiment, for example, the length of the scan start signal FLM of the turn-on level may be 2 horizontal periods.

During the first frame period FP1, the scan driver 13 may alternately apply the scan signals (SS1, SS2, SS3, SS4, . . . ) of the turn-on level to the first scan lines (SL1, SL3, . . . ) and the second scan lines (SL2, SL4, . . . ).

Referring to the driving method described above with reference to FIG. 5, the first scan signal SS1 of the turn-on level may be generated based on the first clock signal CK3 of the turn-on level. In addition, the second scan signal SS2 of the turn-on level may be generated based on the second clock signal CK4 of the turn-on level. Similarly, the first scan signal SS3 of the turn-on level may be generated based on the first clock signal CK1 of the turn-on level. In addition, the second scan signal SS4 of the turn-on level may be generated based on the second clock signal CK2 of the turn-on level.

The data driver 12 may supply data voltages in synchronization with respective scan signals (SS1, SS2, SS3, SS4, . . . ) of the turn-on level. In one embodiment, for example, the data driver 12 may supply the data voltages in the current horizontal period corresponding to grayscale levels latched by a data enable signal DE of the logic high level of the previous horizontal period.

Figure 8:
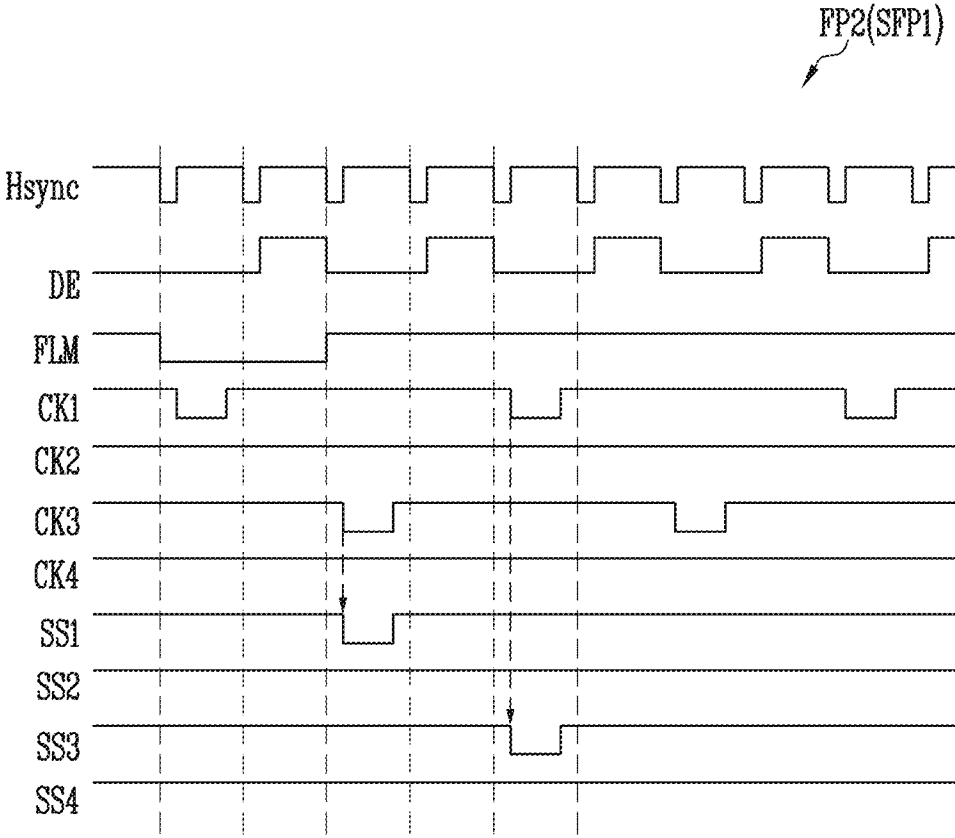

Referring to FIG. 8, control signals in the first sub-frame period SFP1 of the second frame period FP2 are exemplarily shown.

During the first-sub-frame period SFP1, the timing controller 11 may apply the first clock signals CK1 and CK3 of the turn-on level to the first clock lines CKL1 and CKL3, and may maintain the second clock signals CK2 and CK4 of the turn-off level to the second clock lines CKL2 and CKL4. In the first frame period FP1 and the first sub-frame period SFP1, cycles of applying the first clock signals CK1 and CK3 of the turn-on level to the first clock lines CKL1 and CKL3 may be the same as each other. In one embodiment, for example, each cycle of the first clock signals CK1 and CK3 of the turn-on level may be 4 horizontal periods.

In an embodiment, the timing controller 11 may apply the scan start signal FLM of the turn-on level to the scan start line FLML. In such an embodiment, a length of the scan start signal FLM of the turn-on level may be set to overlap the first clock signal CK1 of the turn-on level. In one embodiment, for example, the length of the scan start signal FLM of the turn-on level may be 2 horizontal periods as shown, but not being limited thereto. Alternatively, the length of the scan start signal FLM of the turn-on level may be set to 1 horizontal period, for example.

During the first sub-frame period SFP1, the scan driver 13 may apply the scan signals (SS1, SS3, . . . ) of the turn-on level to the first scan lines (SL1, SL3, . . . ), and may maintain the scan signals (SS2, SS4, . . . ) of the turn-off level to the second scan lines (SL2, SL4, . . . ). In the first frame period FP1 and the first sub-frame period SFP1, cycles of applying the first scan signals (SS1, SS3, . . . ) of the turn-on level to the first scan lines (SL1, SL3, . . . ) may be the same as each other.

The data driver 12 may supply data voltages in synchronization with respective first scan signals (SS1, SS3, . . . ) of the turn-on level. In such an embodiment, the data voltages may not be supplied in synchronization with the second scan signals (SS2, SS4, . . . ), the cycle of the data enable signal DE of the turn-on level in the first sub-frame period SFP1 may be longer than that of the data enable signal DE of the turn-on level in the first frame period FP1. Accordingly, since the cycle in which the data driver 12 changes the data voltages increases, the dynamic power of the data driver 12 may decrease.

Figure 9:
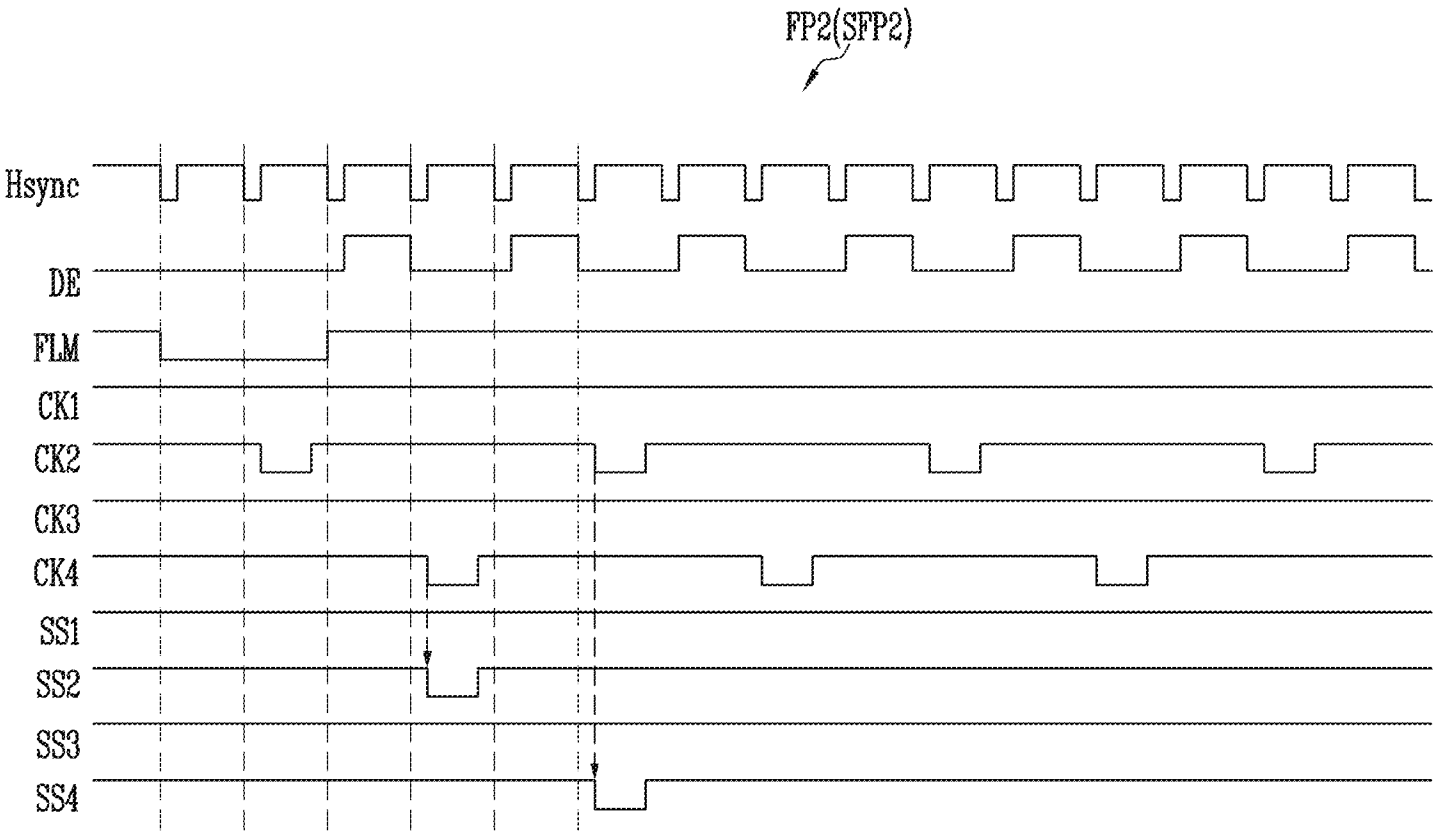

Referring to FIG. 9, control signals in the second sub-frame period SFP2 of the second frame period FP2 are exemplarily shown.

During the second sub-frame period SFP2, the second clock signals CK2 and CK4 of the turn-on level may be applied to the second clock lines CKL2 and CKL4, and the first clock signals CK1 and CK3 of the turn-off level may be maintained to the first clock lines CKL1 and CKL3. In the first frame period FP1 and the second sub-frame period SFP2, cycles of applying the second clock signals CK2 and CK4 of the turn-on level to the second clock lines CKL2 and CKL4 may be the same as each other. In one embodiment, for example, each cycle of the second clock signals CK2 and CK4 of the turn-on level may be 4 horizontal periods.

In an embodiment, the timing controller 11 may apply the scan start signal FLM of the turn-on level to the scan start line FLML. In such an embodiment, a length of the scan start signal FLM of the turn-on level may be set to overlap the second clock signal CK2 of the turn-on level. In one embodiment, for example, the length of the scan start signal FLM of the turn-on level may be 2 horizontal periods as shown, but not being limited thereto. Alternatively, the length of the scan start signal FLM of the turn-on level may be set to 1 horizontal period, for example.

During the second sub-frame period SFP2, the scan driver 13 may apply the second scan signals (SS2, SS4, . . . ) of the turn-on level to the second scan lines (SL2, SL4, . . . ), and may maintain the first scan signals (SS1, SS3, . . . ) of the turn-off level to the first scan lines (SL1, SL3, . . . ). In the first frame period FP1 and the second sub-frame period SFP2, cycles of applying the second scan signals (SS2, SS4, . . . ) of the turn-on level to the second scan lines (SL2, SL4, . . . ) may be the same as each other.

The data driver 12 may supply data voltages to synchronize with respective second scan signals (SS2, SS4, . . . ) of the turn-on level. In this case, since data voltages may not be supplied in synchronization with the first scan signals (SS1, SS3, . . . ), the cycle of the data enable signal DE of the turn-on level in the second sub-frame period SFP2 may be longer than that of the data enable signal DE of the turn-on level in the first frame period FP1. Accordingly, since the cycle in which the data driver 12 changes the data voltages increases, the dynamic power of the data driver 12 may decrease.

FIG. 10 to FIG. 13 illustrate schematic views showing a first frame period and a second frame period according to an alternative embodiment of the invention.

Figure 10:
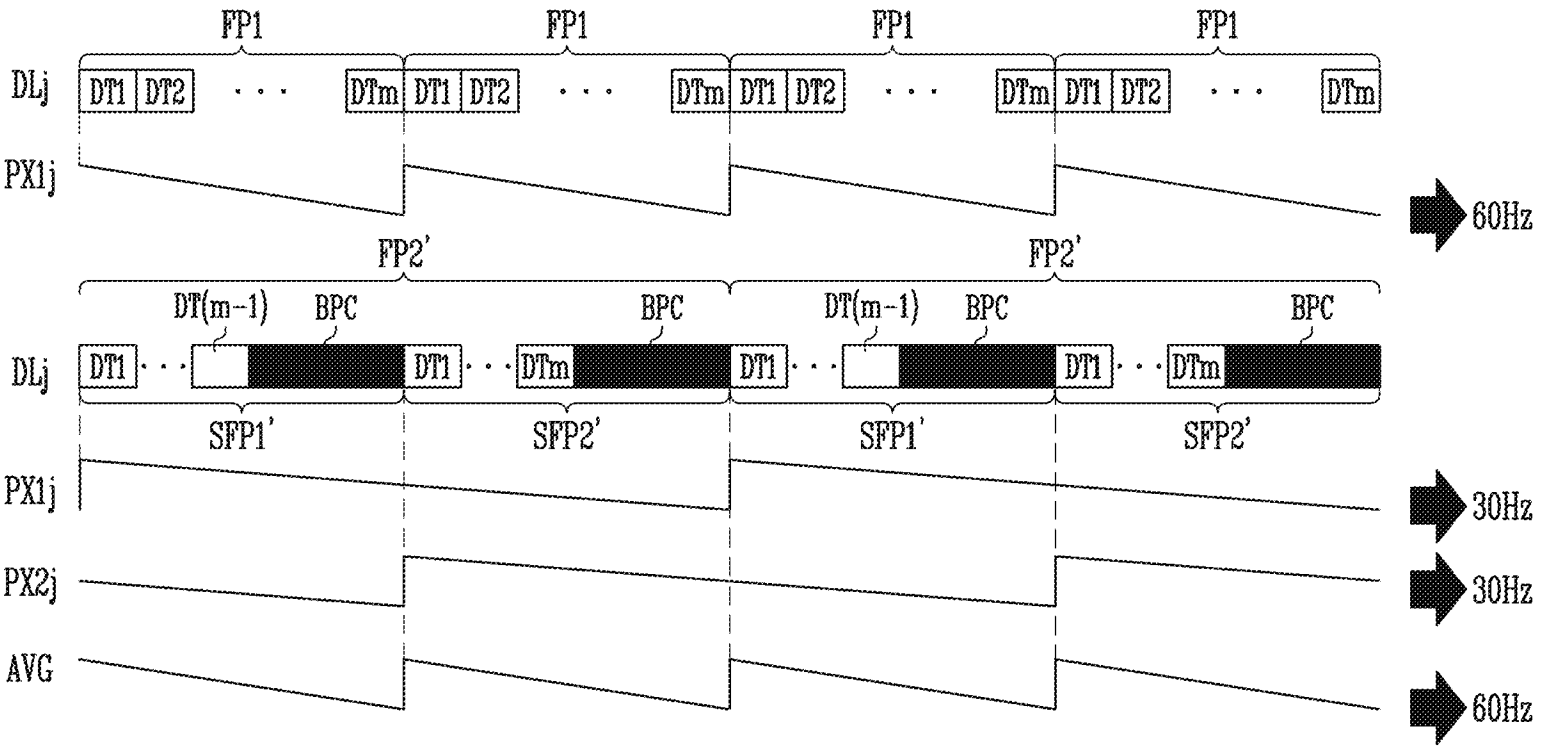
FIG. 10 to FIG. 13 illustrate schematic views showing a first frame period and a second frame period according to an alternative embodiment of the invention.

In such an embodiment of FIG. 10, a luminance waveform and a driving method of the first pixel PX1*j* in the first frame period FP1 are the same as those of FIG. 6. In addition, in such an embodiment of FIG. 10, individual luminance waveforms and an average luminance waveform AVG of the first and second pixels PX1*j* and PX2*j* in a second frame period FP2' are the same as those of FIG. 6.

In such an embodiment, the driving method of the second frame period FP2' as shown in FIG. 10 is different from that of the embodiment of FIG. 6 in that each of a first sub-frame period SFP1' and a second sub-frame period SFP2' includes a data blank period BPC. In one embodiment, for example, a length of each of the first sub-frame period SFP1' and the second sub-frame period SFP2' may be the same as that of each of the first sub-frame period SFP1 and the second sub-frame period SFP2, and the data driver 12 of the embodiment of FIG. 10 may supply data voltages with a shorter cycle than that of FIG. 6. The data blank period BPC may be a period after the data driver 12 completes supplying the data voltages in each of the first sub-frame period SFP1' and the second sub-frame period SFP2' and before the data driver 12 starts supplying data voltages in a next sub-frame period thereof. During the data blank period BPC, all or at least a portion (a gamma amp or digital logic) of the data driver 12 is powered off, so that power consumption may be reduced.

Figure 11:
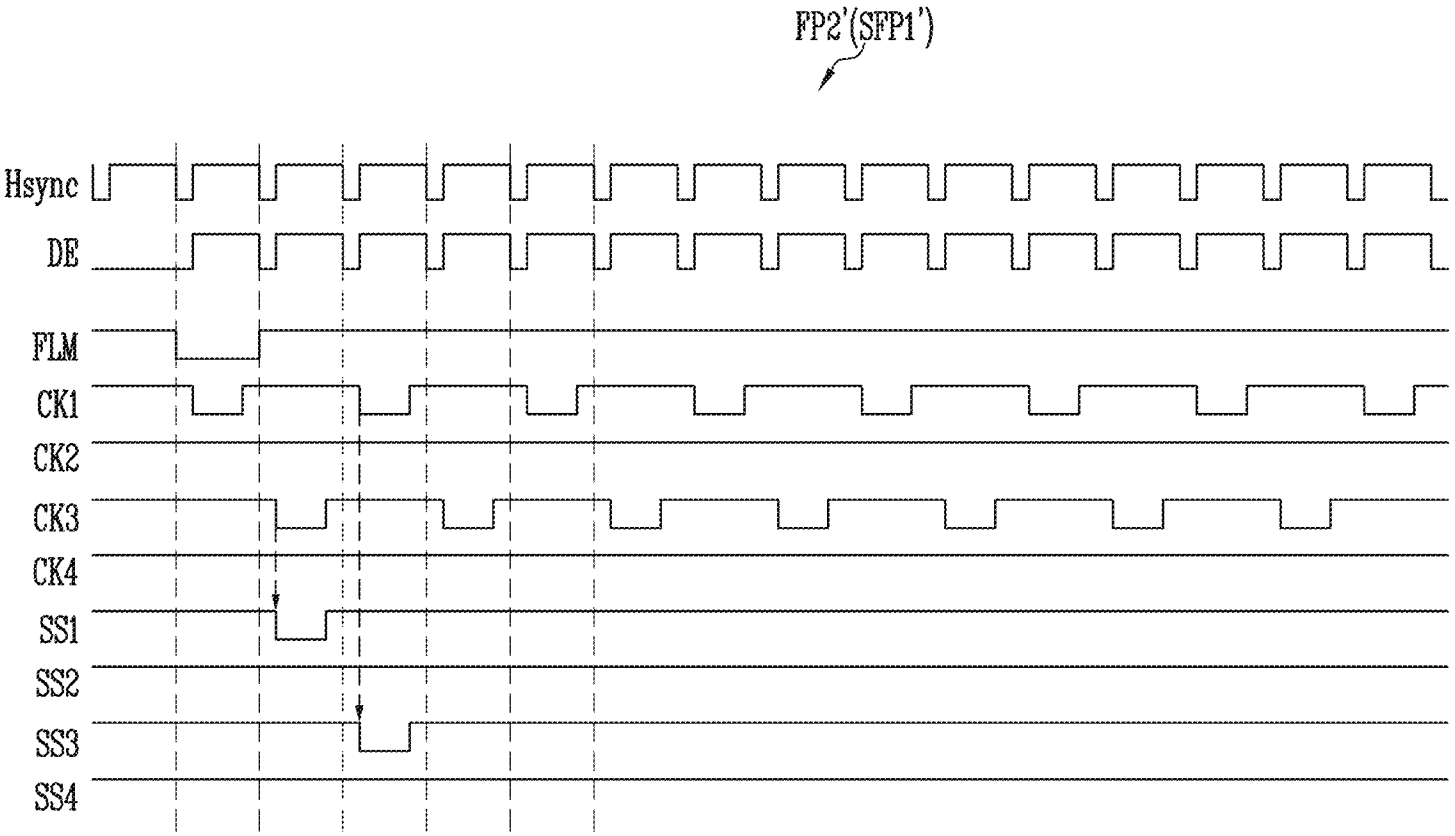

Referring to FIG. 11, control signals in the first sub-frame period SFP1' of the second frame period FP2' are exemplarily shown. Specifically, FIG. 11 shows control signals in a period excluding the data blank period BPC of the first sub-frame period SFP1'.

During the first-sub-frame period SFP1', the timing controller 11 may apply the first clock signals CK1 and CK3 of the turn-on level to the first clock lines CKL1 and CKL3, and may maintain the second clock signals CK2 and CK4 of the turn-off level to the second clock lines CKL2 and CKL4. In such an embodiment, a cycle of applying the first clock signals CK1 and CK3 of the turn-on level to the first clock lines CKL1 and CKL3 in the first sub-frame period SFP1' may be shorter than a cycle of applying the first clock signals CK1 and CK3 of the turn-on level in the first frame period FP1. In one embodiment, for example, each cycle of the first clock signals CK1 and CK3 of the turn-on level may be 2 horizontal periods.

The timing controller 11 may apply the scan start signal FLM of the turn-on level to the scan start line FLML. In such an embodiment, a length of the scan start signal FLM of the turn-on level may be set to overlap the first clock signal CK1 of the turn-on level. In one embodiment, for example, the length of the scan start signal FLM of the turn-on level may be set to 1 horizontal period.

During the first sub-frame period SFP1', the scan driver 13 may apply the scan signals (SS1, SS3, . . . ) of the turn-on level to the first scan lines (SL1, SL3, . . . ), and may maintain the scan signals (SS2, SS4, . . . ) of the turn-off level to the second scan lines (SL2, SL4, . . . ). A cycle of applying the first scan signals (SS1, SS3, . . . ) of the turn-on level to the first scan lines (SL1, SL3, . . . ) in the first sub-frame period SFP1' may be shorter than a cycle of applying the first scan signals (SS1, SS3, . . . ) of the turn-on level in the first frame period FP1.

The data driver 12 may supply data voltages in synchronization with respective first scan signals (SS1, SS3, . . . ) of the turn-on level.

Figure 12:
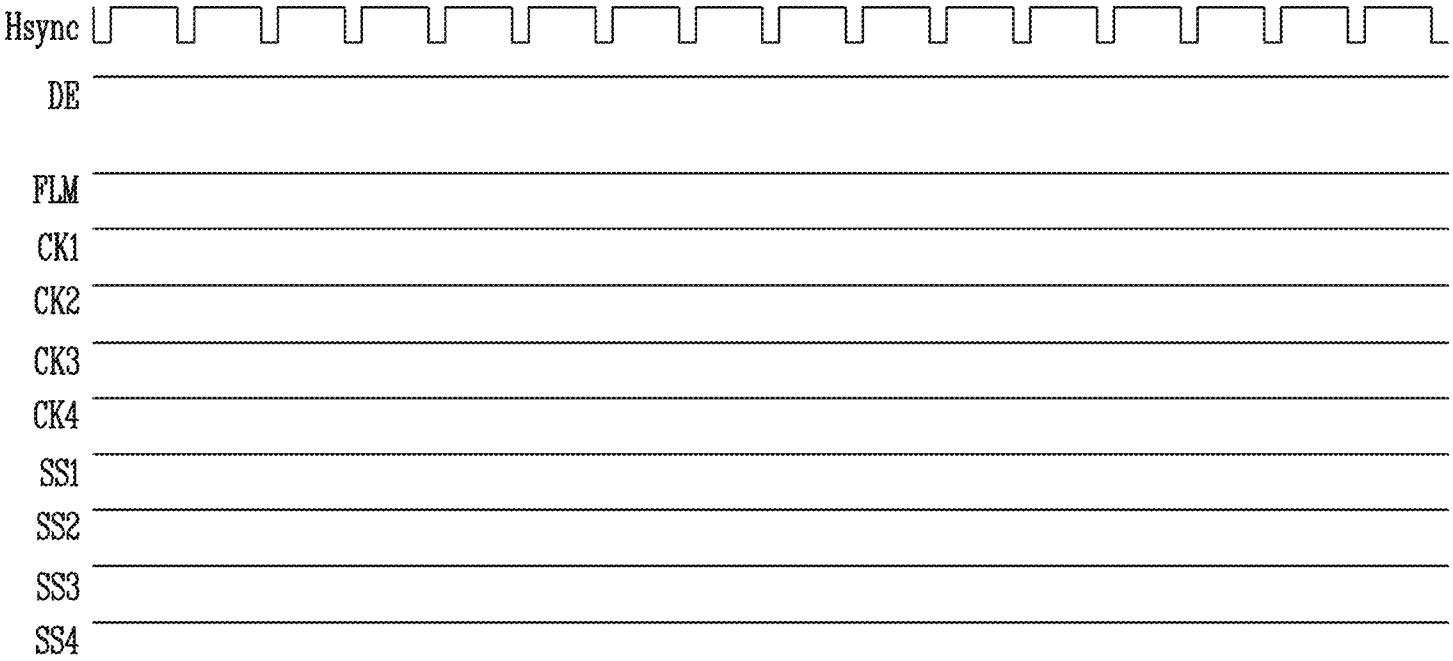

Referring to FIG. 12, control signals in the data blank period BPC of the second frame period FP2' are exemplarily shown. In the data blank period BPC, the clock signals CK1, CK2, CK3, and CK4) of the turn-off level, the scan signals (SS1, SS2, SS3, SS4, . . . ) of the turn-off level, and the scan start signal FLM of the turn-off level may be maintained.

As described above, during the data blank period BPC, all or at least a portion (a gamma amp or a digital logic) of the data driver 12 is powered off, so that power consumption may be reduced.

Figure 13:
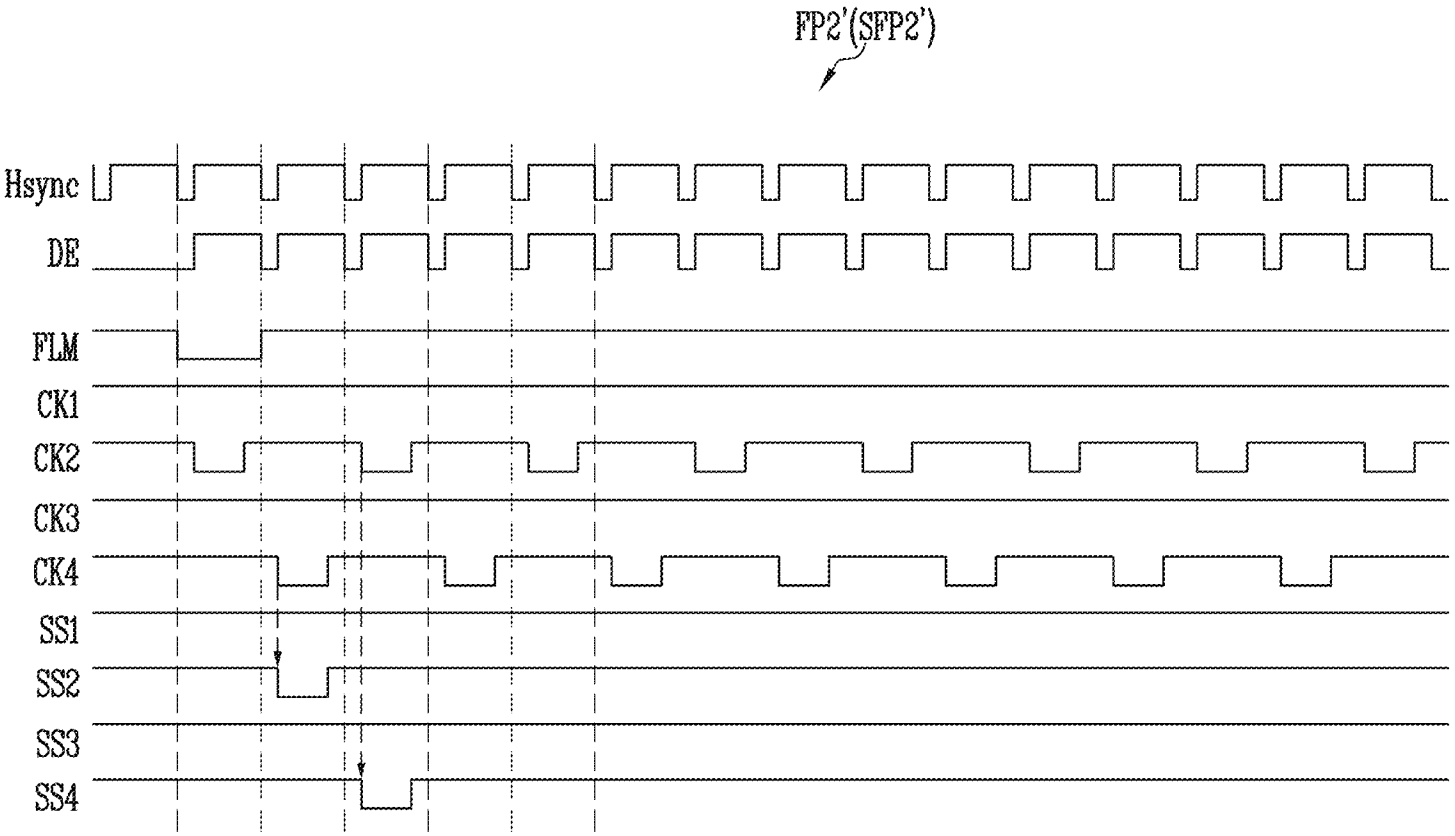

Referring to FIG. 13, control signals in the second sub-frame period SFP2' of the second frame period FP2' are exemplarily shown. Specifically, FIG. 13 shows control signals in a period excluding the data blank period BPC of the second sub-frame period SFP2'.

During the second sub-frame period SFP2', the second clock signals CK2 and CK4 of the turn-on level may be applied to the second clock lines CKL2 and CKL4, and the first clock signals CK1 and CK3 of the turn-off level may be maintained to the first clock lines CKL1 and CKL3. A cycle of applying the first clock signals CK2 and CK4 of the turn-on level to the second clock lines CKL2 and CKL4 in the second sub-frame period SFP2' may be shorter than a cycle of applying the second clock signals CK2 and CK4 of the turn-on level in the first frame period FP1. In one embodiment, for example, each cycle of the second clock signals CK2 and CK4 of the turn-on level may be 2 horizontal periods.

In such an embodiment, the timing controller 11 may apply the scan start signal FLM of the turn-on level to the scan start line FLML. In such an embodiment, a length of the scan start signal FLM of the turn-on level may be set to overlap the second clock signal CK2 of the turn-on level. In one embodiment, for example, the length of the scan start signal FLM of the turn-on level may be set to 1 horizontal period.

During the second sub-frame period SFP2', the scan driver 13 may apply the second scan signals (SS2, SS4, . . . ) of the turn-on level to the second scan lines (SL2, SL4, . . . ), and may maintain the first scan signals (SS1, SS3, . . . ) of the turn-off level to the first scan lines (SL1, SL3, . . . ). A cycle of applying the second scan signals (SS2, SS4, . . . ) of the turn-on level to the second scan lines (SL2, SL4, . . . ) in the second sub-frame period SFP2' may be shorter than a cycle of applying the second scan signals (SS2, SS4, . . . ) of the turn-on level in the first frame period FP1.

The data driver 12 may supply data voltages in synchronization with respective second scan signals (SS2, SS4, . . . ) of the turn-on level.

Figure 14:
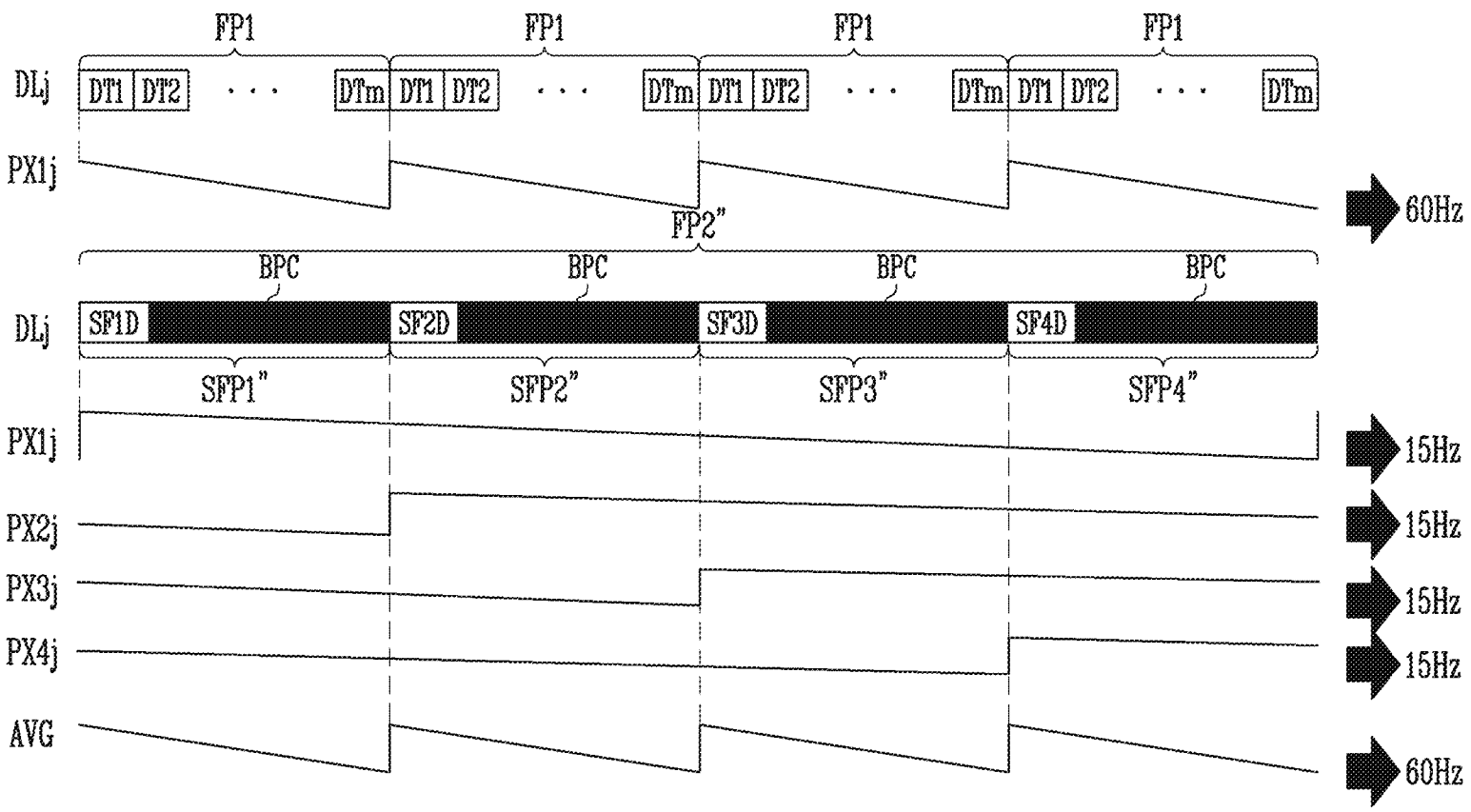
FIG. 14 illustrates a schematic view showing a first frame period and a second frame period according to another alternative embodiment of the invention.

FIG. 14 illustrates a schematic view showing a first frame period and a second frame period according to another alternative embodiment of the invention.

In the embodiment of FIG. 14, a luminance waveform and a driving method of the first pixel PX1*j* in the first frame period FP1 are the same as those of FIG. 6.

The driving method of the second frame period FP2" of FIG. 14 is the same as or similar to that of FIG. 10, except that each second frame period FP2" includes four sub-frame periods SFP1", SFP2", SFP3", and SFP4". In one embodiment, for example, the second frame period FP2" is four times the first frame period FP1, and thus may be 1/15 second. In one embodiment, for example, each of the sub-frame periods SFP1", SFP2", SFP3", and SFP4" may be 1/60 second.

In an embodiment, as shown in FIG. 10, two pixel rows form or collectively define one group. In an alternative embodiment, as shown in FIG. 14 four adjacent pixel rows form or collectively define one group. The first pixel PX1*j* in the first pixel row may receive a data voltage SF1D in the first sub-frame period SFP1", and may emit light with the luminance corresponding to the data voltage SF1D and then gradually decreasing. A second pixel PX2*j* in a second pixel row may receive a data voltage SF2D in the second sub-frame period SFP2", and may emit light with the luminance corresponding to the data voltage SF2D and then gradually decreasing. A third pixel PX3*j* in a third pixel row may receive a data voltage SF3D in the third sub-frame period SFP3", and may emit light with the luminance corresponding to the data voltage SF3D and then gradually decreasing. A fourth pixel PX4*j* in a fourth pixel row may receive a data voltage SF4D in the fourth sub-frame period SFP4", and may emit light with the luminance corresponding to the data voltage SF4D and then gradually decreasing. Accordingly, even if each of the pixels PX1*j*, PX2*j*, PX3*j*, and PX4*j* emit light at 15 Hz, an average luminance waveform AVG of a group of pixels PX1*j*, PX2*j*, PX3*j*, and PX4*j* may be recognized as 60 Hz.

Referring to FIG. 10 and FIG. 14, the number of sub-frame periods SFP1" to SFP4" included in the second frame period FP2" may be variously set.

Figure 15:
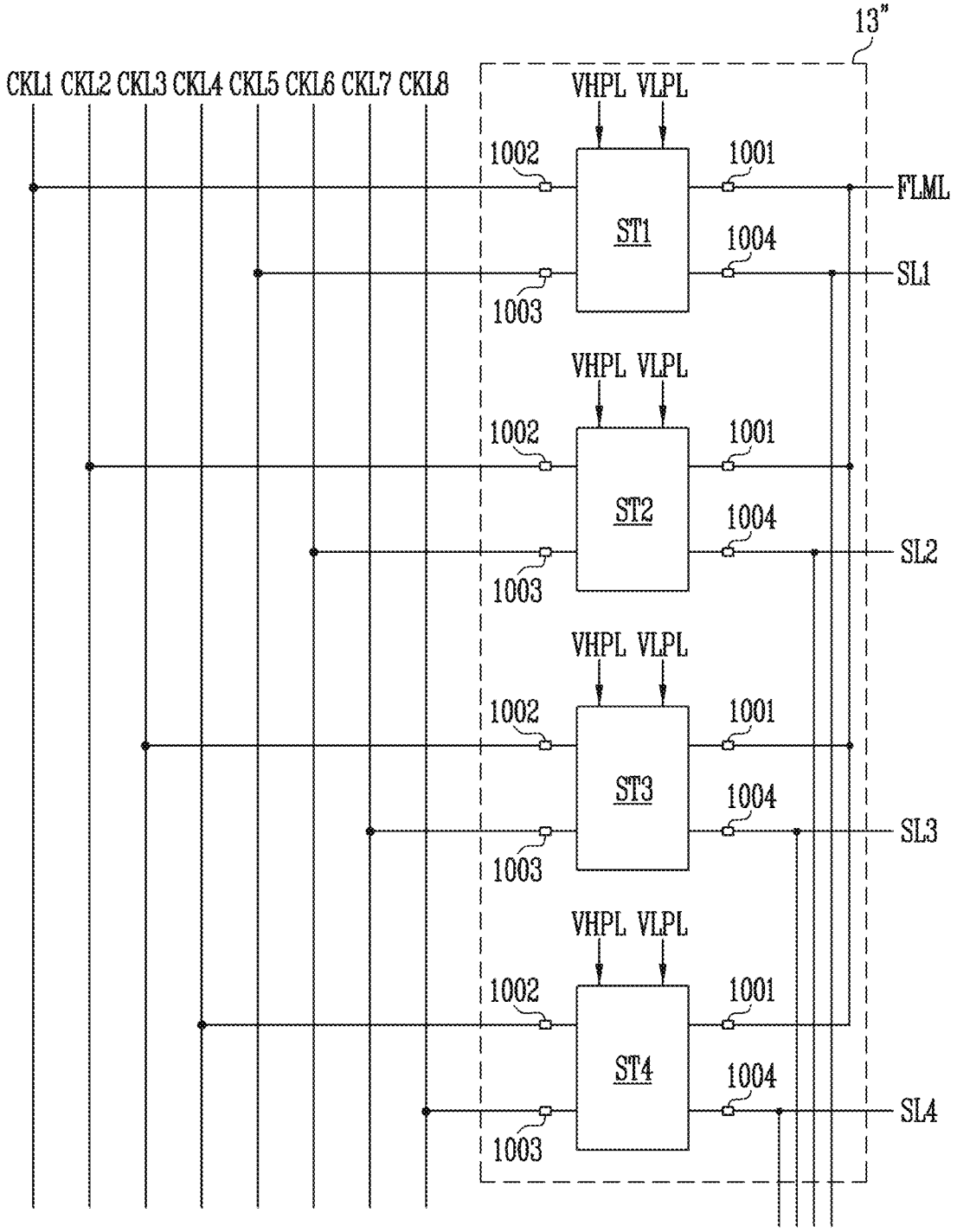
FIG. 15 illustrates a schematic view showing a scan driver according to an alternative embodiment of the invention.

FIG. 15 illustrates a schematic view showing a scan driver according to an alternative embodiment of the invention.

A scan driver 13" of FIG. 15 is substantially the same as the scan driver 13 of FIG. 3 except that the scan driver 13" of FIG. 15 is partially modified based on the driving method of FIG. 14. Internal circuit configurations of stages ST1 to ST4 of the scan driver 13" and the scan driver 13 may be the same as each other.

The embodiment of the scan driver 13 of FIG. 3 divided into two stage groups (odd-numbered stages and even-numbered stages), while the embodiment of the scan driver 13" of FIG. 15 may be divided into four stage groups. In one embodiment, for example, a first stage group includes (4q+1)-th stages (ST1, . . . ), and respective stages (ST1, . . . ) may be alternately connected to clock lines CKL1 and CKL5. Here, q may be a positive integer. A second stage group includes (4q+2)-th stages (ST2, . . . ), and respective stages (ST2, . . . ) may be alternately connected to clock lines CKL2 and CKL6. A third stage group includes (4q+3)-th stages (ST3, . . . ), and respective stages (ST3, . . . ) may be alternately connected to clock lines CKL3 and CKL7. A fourth stage group includes (4q+4)-th stages (ST4, . . . ), and respective stages (ST4, . . . ) may be alternately connected to clock lines CKL4 and CKL8.

The first input terminal 1001 of the first stages ST1, ST2, ST3, and ST4 of each stage group may be connected to the scan start line FLML. The driving method of the scan driver 13" is similar to that of the scan driver 13, and any repetitive detailed description thereof will be omitted.

Figure 16:
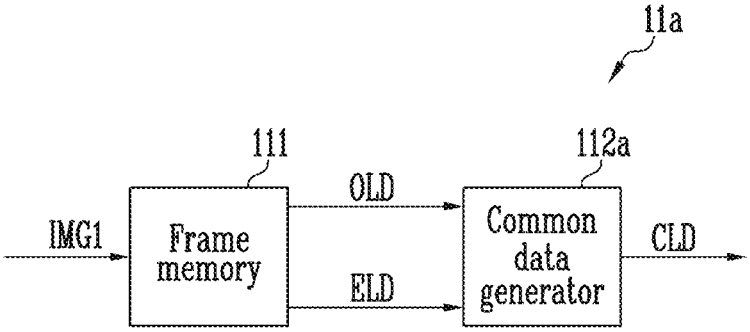
FIG. 16 illustrates a schematic view showing a timing controller according to an embodiment of the invention.
Figure 17:
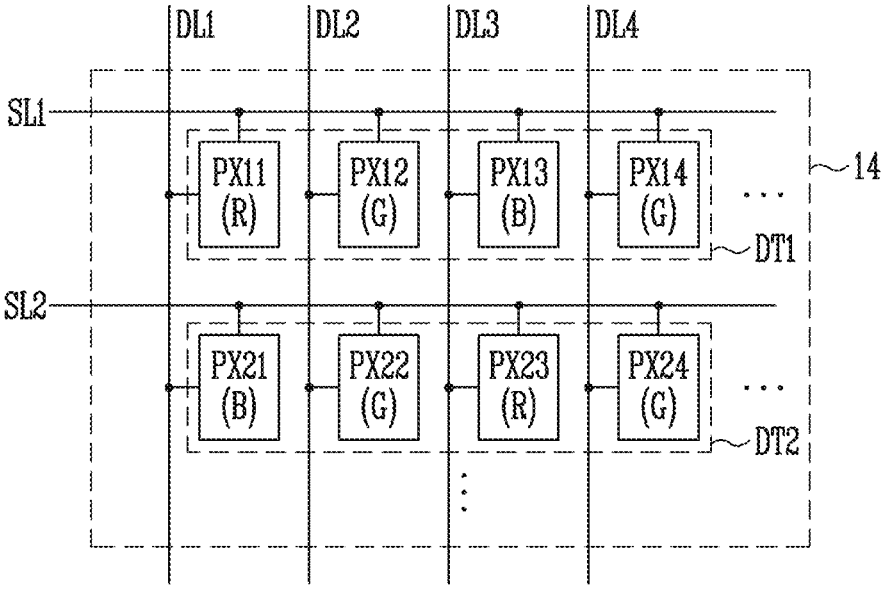
FIG. 17 illustrates a schematic view showing a pixel portion according to an embodiment of the invention.
Figure 18:
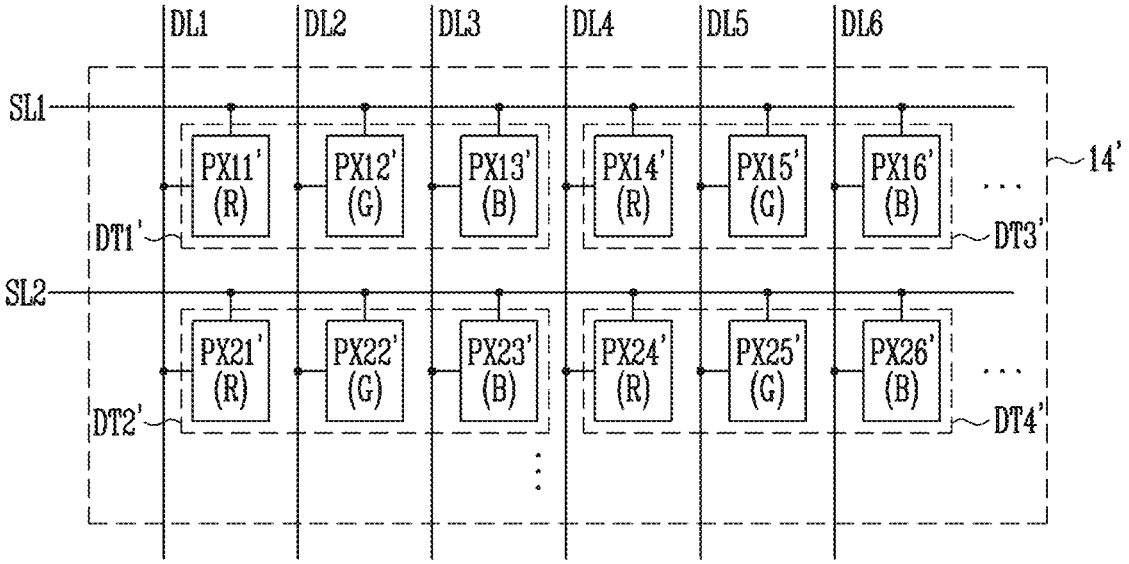
FIG. 18 illustrates a schematic view showing a pixel portion according to an alternative embodiment of the invention.

FIG. 16 illustrates a schematic view showing a timing controller according to an embodiment of the invention. FIG. 17 illustrates a schematic view showing a pixel portion according to an embodiment of the invention. FIG. 18 illustrates a schematic view showing a pixel portion according to an alternative embodiment of the invention.

Referring to FIG. 16, an embodiment of a timing controller 11*a* according to the invention may include a frame memory 111 and a common data generator 112*a*. The common data generator 112*a* may be used when the display device 10 is in the second display mode. When the display device 10 is in the first display mode, the common data generator 112*a* is not used, first line data OLD may be used for the first pixel row, and second line data ELD may be used for the second pixel row. Hereinafter, an embodiment of the display device 10 driven in the second display mode will be described in detail.

Referring to FIG. 17, an embodiment where a pixel portion 14 is arranged in a pentile structure is illustrated as an example. In one embodiment, for example, the pixel portion 14 may include the first pixel rows connected to the first scan lines (SL1, . . . ), and the second pixel rows alternating with the first pixel rows and connected to the second scan lines (SL2, . . . ). Each of the first pixel rows may include first dots DT1, and each of the second pixel rows may include second dots DT2. A dot may include at least two pixels of different colors. The dot may be a display unit for displaying a combined color. An external processor may provide grayscale levels in dot units.

The first dot DT1 of the first pixel row may include a red pixel PX11, a green pixel PX12, a blue pixel PX13, and a green pixel PX14. The second dot DT2 of the second pixel row may include a blue pixel PX21, a green pixel PX22, a red pixel PX23, and a green pixel PX24. In such an embodiment, the first dot DT1 and a second dot DT2 that are closest to each other in the first and second pixel rows may be referred to as a pair of dots. Here, a degree at which the pixels are adjacent to each other may be determined based on a degree at which light emitting surfaces of light emitting diodes of the pixels are adjacent to each other.

Referring to FIG. 18, an alternative embodiment where a pixel portion 14' is arranged in an RGB stripe structure is illustrated as an example. A first dot DT1' may include a red pixel PX11', a green pixel PX12', and a blue pixel PX13'. A first dot DT3' may include a red pixel PX14', a green pixel PX15', and a blue pixel PX16'. A second dot DT2' may include a red pixel PX21', a green pixel PX22', and a blue pixel PX23'. A second dot DT4' may include a red pixel PX24', a green pixel PX25', and a blue pixel PX26'. The first dot DT1' and the second dot DT2' that are closest to each other may form a pair of dots, and the first dot DT3' and the second dot DT4' that are closest to each other may form another pair of dots. Hereinafter, for convenience of description, the pixel portion 14 of FIG. 17 will be mainly described.

The frame memory 111 may store an input image IMG1. In one embodiment, for example, the frame memory 111 may store grayscale levels corresponding to at least one frame period. The frame memory 111 may provide the first line data OLD for the first dots DT1 in the first pixel row and the second line data ELD for the second dots DT2 in the second pixel row.

The common data generator 112*a* may provide common line data CLD with respect to the first dots DT1 and the second dots DT2. In one embodiment, for example, the common line data CLD may be generated based on the first line data OLD and the second line data ELD. In one embodiment, for example, the common line data CLD may be an average value or a median value of the first line data OLD and the second line data ELD. In the common line data CLD, the first dot DT1 and the second dot DT2 of each of the pairs of dots may have the same grayscale level for the same color.

The data driver 12 may supply first data voltages to the first dots of the first pixel row during the first sub-frame period. In addition, the data driver 12 may supply second data voltages to the second dots of the second pixel row adjacent to the first dots during the second sub-frame period. In this case, the first data voltages and the second data voltages may be based on the common line data CLD. Accordingly, the first data voltages and the second data voltages may be the same for the same color. In one embodiment, for example, the same data voltages may be supplied to the first pixel PX11 and the second pixel PX23 that are red, the same data voltages may be supplied to the first pixel PX12 and the second pixel PX22 that are green, the same data voltages may be supplied to the first pixel PX13 and the second pixel PX21 that are blue, and the same data voltages may be supplied to the first pixel PX14 and the second pixel PX24 that are green.

According to an embodiment, as described above, the same data voltages are supplied to a pair of dots of adjacent pixel rows, such that the average luminance waveform AVG may be effectively prevented from being rapidly changed during the second frame periods.

Figure 19:
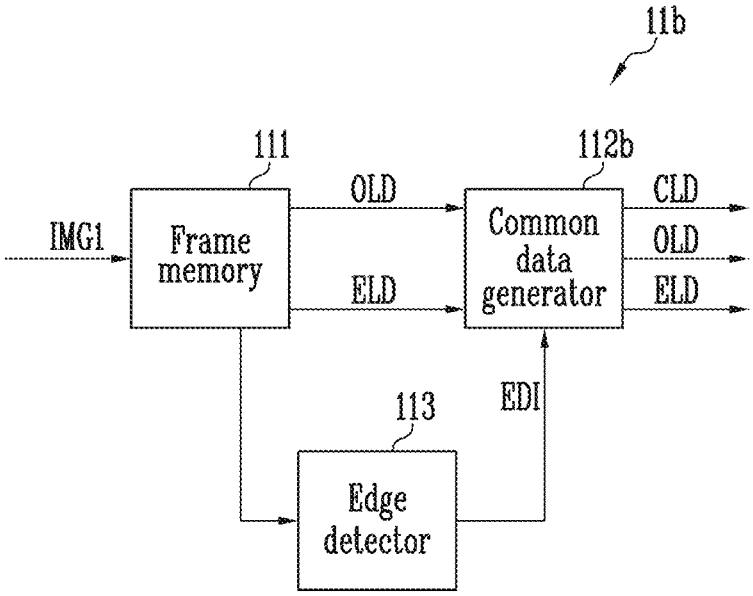
FIG. 19 to FIG. 21 illustrate schematic views showing a timing controller according to alternative embodiments of the invention.
Figure 20:
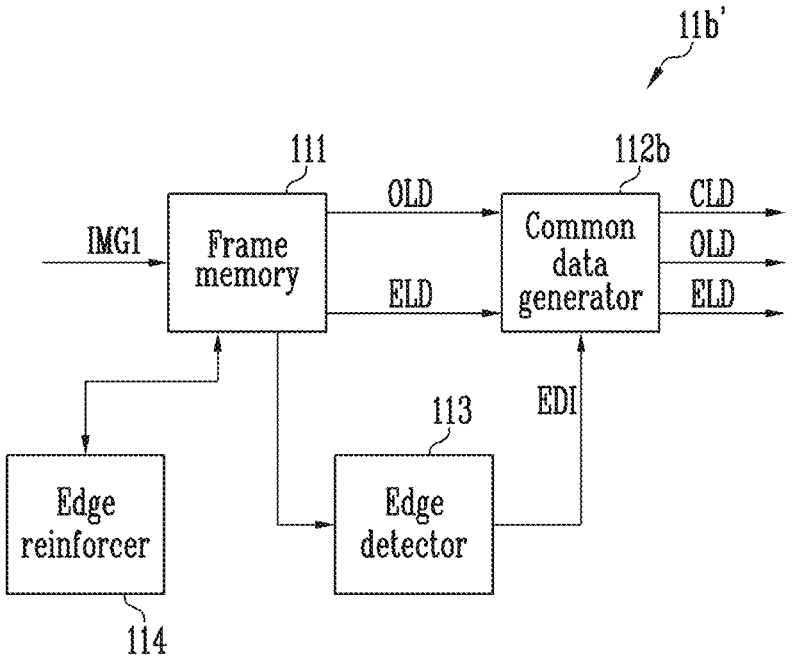
Figure 21:
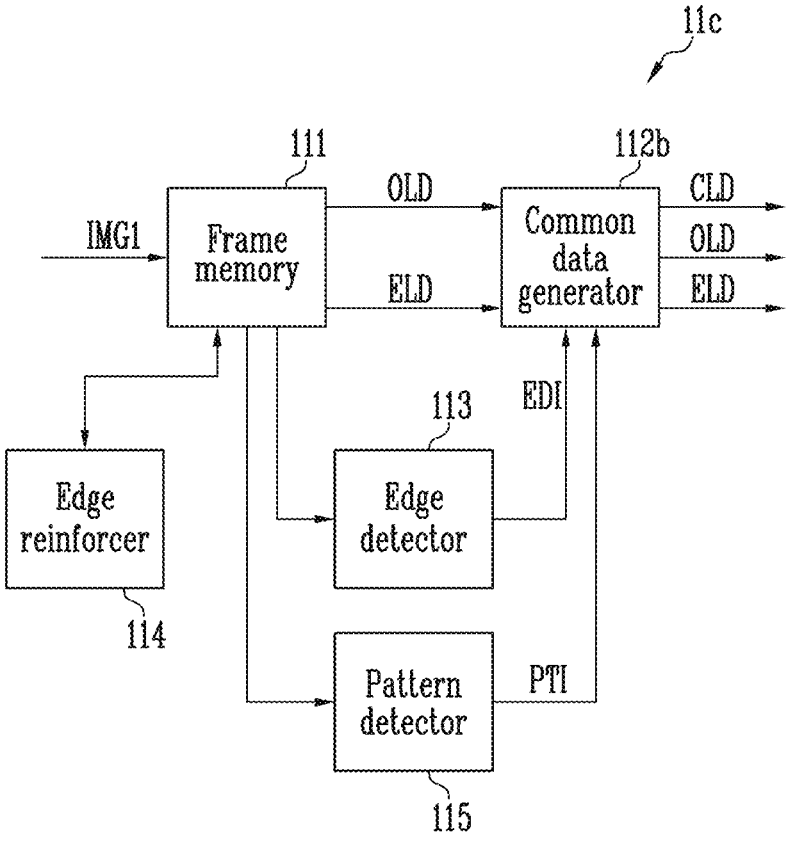

FIG. 19 to FIG. 21 illustrate schematic views showing a timing controller according to alternative embodiments of the invention.

Referring to FIG. 19, an embodiment of a timing controller 11*b* may further include an edge detector 113 based on the timing controller 11*a*.

The edge detector 113 may detect an edge of the input image IMG1 stored in the frame memory 111. The edge may be a portion in which grayscale levels are rapidly changed as in a border line in the input image IMG1. In one embodiment, for example, when a difference between grayscale levels of the first pixel row and grayscale levels of the adjacent second pixel row is greater than or equal to a reference value, it may be determined that the first pixel row and the second pixel row correspond to an edge. The edge detector 113 may generate edge information EDI based on a detected edge.

When the first pixel row and the second pixel row that are adjacent to each other do not correspond to the detected edge, a common data generator 112*b* may provide the same grayscale levels (for example, common line data CLD) to the first dots DT1 and the second dots DT2. Accordingly, when the first pixel row and the second pixel row that are adjacent to each other do not display an edge, first data voltages supplied by the data driver 12 to the first dots DT1 of the first pixel row during the first sub-frame period and second data voltages supplied by the data driver 12 to the second dots DT2 of the second pixel row adjacent to the first dots DT1 during the second sub-frame period, may be identical to each other with respect to the same color.

In such an embodiment, when the first pixel row and the second pixel row that are adjacent to each other correspond to the detected edge, the common data generator 112*b* may provide grayscale levels of the input image IMG1 to the first dots DT1 and the second dots DT2. That is, the common data generator 112*b* may provide the first line data OLD to the first dots DT1, and may provide the second line data ELD to the second dots DT2. Accordingly, when the first pixel row and the second pixel row that are adjacent to each other display an edge, the first data voltages and the second data voltages may be different with respect to the same color such that an edge of an image may be effectively prevented from becoming blurred.

Referring to FIG. 20, an alternative embodiment of a timing controller 11*b*' may further include an edge reinforcer 114 in addition to the elements of the timing controller 11*b* shown in FIG. 19.

The edge reinforcer 114 may convert the input image IMG1 so that the edge of the input image IMG1 is emphasized. Therefore, an edge may be effectively prevented in advance from being blurred by the common line data CLD. When the first pixel row and the second pixel row that are adjacent to each other correspond to the detected edge, the common data generator 112*b* may provide grayscale levels of the input image IMG1 converted by the edge reinforcer 114 to the first dots DT1 and the second dots DT2.

Referring to FIG. 21, another alternative embodiment of a timing controller 11*c* may further include a pattern detector 115 in addition to the elements of the timing controller 11*b*' shown in FIG. 20.

The pattern detector 115 may generate pattern information PTI indicating whether the converted input image IMG1 corresponds to a previously stored pattern. The previously stored pattern may be a worst pattern such as a horizontal stripe pattern.

In such an embodiment, when the converted input image IMG1 corresponds to the previously stored pattern, the display device 10 may operate in the first display mode including the first frame periods. In such an embodiment, when the converted input image IMG1 does not correspond to the previously stored pattern, the display device 10 may operate in the second display mode including the second frame periods.

Accordingly, in such an embodiment, the second display mode describe above is applied thereto, such that the display device 10 may be driven in the first display mode for a predetermined pattern which a flicker is recognized when displayed.

The invention should not be construed as being limited to the embodiments set forth herein. Rather, these embodiments are provided so that this disclosure will be thorough and complete and will fully convey the concept of the invention to those skilled in the art.

While the invention has been particularly shown and described with reference to embodiments thereof, it will be understood by those of ordinary skill in the art that various changes in form and details may be made therein without departing from the spirit or scope of the invention as defined by the following claims.

What is claimed is:

1. A display device comprising:

a pixel portion including first pixel rows connected to first scan lines, and second pixel rows alternating with the first pixel rows and connected to second scan lines;

a scan driver including first stages connected to the first scan lines, and second stages connected to the second scan lines; and a data driver connected to the first pixel rows and the second pixel rows through same data lines, wherein the first stages are connected to first clock lines, the second stages are connected to second clock lines different from the first clock lines, a first start stage of the first stages and a second start stage of the second stages are connected to a same scan start line, each of the first stages excluding the first start stage is connected to a first scan line of a previous first stage, each of the second stages excluding the second start stage is connected to a second scan line of a previous second stage, the scan driver sequentially applies scan signals of a turn-on level alternately to the first scan lines and the second scan lines during each first frame period, wherein the display device operates at a first frequency during each first frame period, the scan driver sequentially applies the scan signals of the turn-on level to all of the first scan lines, and maintains scan signals of a turn-off level at all of the second scan lines, during a first sub-frame period of each second frame period, wherein the display device operates at a second frequency, which is lower than the first frequency, during each second frame period, wherein the first clock signals of a turn-on level are applied to the first clock lines, and second clock signals of a turn-off level are maintained at the second clock lines, during the first sub-frame period of each second frame period, the scan driver sequentially applies the scan signals of the turn-on level to all of the second scan lines, and maintains the scan signals of the turn-off level at all of the first scan lines, during a second sub-frame period of each second frame period, wherein the second sub-frame period starts after the first sub-frame period ends in each second frame period, wherein second clock signals of the turn-on level are applied to the second clock lines, and first clock signals of the turn-off level are maintained at the first clock lines, during the second sub-frame period of each second frame period, the scan start line receives a scan start signal in each of the first sub-frame period and the second sub-frame period, and a cycle of applying the scan signals of the turn-on level to the first scan lines in the first sub-frame period of each second frame period, during which the display device operates at the second frequency, is shorter than a cycle of applying the scan signals of the turn-on level to the first scan lines in each first frame period during which the display device operates at the first frequency.

2. The display device of claim 1, wherein the second frame period is longer than the first frame period.

3. The display device of claim 2, wherein the second frame period is an integer multiple of the first frame period.

4. The display device of claim 1, wherein the first clock signals of the turn-on level are applied to the first clock lines, and the second clock signals of the turn-on level are applied to the second clock lines, during the first frame period; and the first clock signals and the second clock signals have different phases from each other.

5. The display device of claim 1, wherein a cycle of applying the first clock signals of the turn-on level to the first clock lines in the first sub-frame period is shorter than a cycle of applying the first clock signals of the turn-on level in the first frame period.

6. The display device of claim 5, wherein a cycle of applying the second clock signals of the turn-on level to the second clock lines in the second sub-frame period is shorter than a cycle of applying the second clock signals of the turn-on level in the first frame period.

7. The display device of claim 6, wherein a cycle of applying the scan signals of the turn-on level to the second scan lines in the second sub-frame period is shorter than a cycle of applying the scan signals of the turn-on level to the second scan lines in the first frame period.

8. The display device of claim 6, wherein the data driver is powered off during at least a portion of the first sub-frame period and the second sub-frame period.

9. The display device of claim 1, wherein first data voltages supplied by the data driver to first dots of a first pixel row during the first sub-frame period and second data voltages supplied by the data driver to second dots of a second pixel row adjacent to the first dots during the second sub-frame period are the same as each other for a same color, and each of the first and second dots include pixels of at least two different colors.

10. The display device of claim 1, wherein when a first pixel row and an adjacent second pixel row do not display an edge, first data voltages supplied by the data driver to first dots of the first pixel row during the first sub-frame period and second data voltages supplied by the data driver to second dots of the second pixel row adjacent to the first dots during the second sub-frame period are the same as each other for a same color;

when the first pixel row and the adjacent second pixel row display an edge, the first data voltages and the second data voltages are different from each other for the same color; and each of the first and second dots includes pixels of at least two different colors.

11. The display device of claim 10, further comprising a timing controller which supplies a control signal to the scan driver and the data driver, wherein the timing controller includes:

a frame memory which stores an input image;

an edge reinforcer which converts the input image in a way such that an edge of the input image is emphasized;

an edge detector which detects an edge of a converted input image; and a common data generator which provides same grayscale levels to the first dots and the second dots when the first pixel row and the adjacent second pixel row do not correspond to the detected edge, and provides grayscale levels of the converted input image to the first dots and the second dots when the first pixel row and the adjacent second pixel row correspond to the detected edge.

12. The display device of claim 11, wherein the timing controller further includes a pattern detector which generates pattern information on whether the converted input image corresponds to a previously stored pattern;

when the input image corresponds to the pattern, the display device operates in a first display mode including the first frame period; and when the input image does not correspond to the pattern, the display device operates in a second display mode including the second frame period.

* * * * *